US007003221B2

(12) United States Patent
Tsujimura

(10) Patent No.: US 7,003,221 B2
(45) Date of Patent: Feb. 21, 2006

(54) METHOD OF AND APPARATUS FOR PACKAGING LIGHT-SHIELDING PHOTOSENSITIVE MATERIAL ROLL, AND APPARATUS FOR HEATING AND SUPPLYING FLUID

(75) Inventor: Koji Tsujimura, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/898,346

(22) Filed: Jul. 26, 2004

(65) Prior Publication Data

US 2005/0008349 A1 Jan. 13, 2005

Related U.S. Application Data

(62) Division of application No. 09/942,996, filed on Aug. 31, 2001, now Pat. No. 6,860,087.

(30) Foreign Application Priority Data

Sep. 1, 2000 (JP) ..... 2000-265880
Sep. 1, 2000 (JP) ..... 2000-266119

(51) Int. Cl.
*F24H 1/10* (2006.01)

(52) U.S. Cl. ..... 392/492; 392/491; 392/494

(58) Field of Classification Search ..... 392/379, 392/465, 480, 491, 492, 494; 53/442, 557
See application file for complete search history.

(56) References Cited

U.S. PATENT DOCUMENTS

| | | | | |
|---|---|---|---|---|
| 1,767,122 | A * | 6/1930 | Dean | 392/492 |
| 3,634,687 | A | 1/1972 | Somerset et al. | |
| 5,097,106 | A | 3/1992 | Arai et al. | |
| 5,133,788 | A | 7/1992 | Backus | |
| 5,155,799 | A | 10/1992 | Andersson et al. | |
| 5,255,959 | A | 10/1993 | Loegel | |
| 5,618,253 | A | 4/1997 | Okushita | |
| 6,018,929 | A | 2/2000 | Suzuki et al. | |
| 6,179,123 | B1 | 1/2001 | Shigeta et al. | |
| 6,282,746 | B1 | 9/2001 | Schleeter | |

FOREIGN PATENT DOCUMENTS

JP 11-264313 A 9/1999

* cited by examiner

*Primary Examiner*—Tu B Hoang
*Assistant Examiner*—Vinod Patel
(74) *Attorney, Agent, or Firm*—Sughrue Mion, PLLC

(57) ABSTRACT

A packaging apparatus has hot air supply mechanisms disposed in association with light-shielding shrinkable films wound on a rolled photosensitive material sheet, for ejecting hot air locally to the light-shielding shrinkable films, and a drive mechanism for relatively rotating the hot air supply mechanisms along an outer circumferential surface of the rolled photosensitive material sheet.

19 Claims, 21 Drawing Sheets

METHOD OF AND APPARATUS FOR PACKAGING LIGHT-SHIELDING PHOTOSENSITIVE MATERIAL ROLL, AND APPARATUS FOR HEATING AND SUPPLYING FLUID

This is a divisional application of Ser. No. 09/942,996 filed Aug. 31, 2001 now U.S. Pat. No. 6,860,087, the entire disclosure of which is incorporated herein by reference.

BACKGROUND OF THE INVENTION

1. Field of the Invention

The present invention relates to a method of and an apparatus for packaging a light-shielded photosensitive material roll which comprises a rolled photosensitive material sheet, a pair of light-shielding members mounted on respective opposite ends of the rolled photosensitive material sheet, alight-shielding sheet wound around the rolled elongate photosensitive material sheet, and a pair of heat-shrinkable package members separately or integrally mounted on respective transversely opposite ends of the light-shielding sheet and heat-shrunk in covering relation to outer peripheral edges of the light-shielding members, and an apparatus for heating a fluid with a heating body and supplying the heated fluid to an object to be heated.

2. Description of the Related Art

Roll films for use in the plate making field are in the form of a light-shielded photosensitive material roll which comprises a rolled elongate photosensitive material sheet wound around a core, a pair of light-shielding members mounted on respective opposite ends of the rolled elongate photosensitive material sheet, and a light-shielding sheet (light-shielding leader) wound around the rolled elongate photosensitive material sheet.

Various proposals have heretofore been made in the art with respect to light-shielded photosensitive material rolls. For example, the invention disclosed in Japanese patent application No. 11-50946 is concerned with the easy manufacture of a light-shielded photosensitive material roll.

Specifically, as shown in FIG. 20 of the accompanying drawings, disk-shaped light-shielding members 2 are attached to respective opposite ends of a photosensitive material roll 1, and an elongate heat-shrinkable light-shielding leader 3 that is heat-shrinkable in the longitudinal direction thereof is wound around the photosensitive material roll 1. The wound light-shielding leader 3 has its outer end fixed in position by a tape 4. Then, in order to shrink the light-shielding leader 3 with heat, the photosensitive material roll 1 is introduced into a shrinking tunnel 5, and a heater in the shrinking tunnel 5 is energized to heat the light-shielding leader 3. The light-shielding leader 3 is shrunk with heat, forcibly bringing opposite ends 3*a* thereof into close contact with the outer surfaces of the disk-shaped light-shielding members 2, whereupon a light-shielded photosensitive material roll 6 is completed.

As described above, the shrinking tunnel 5 is used to heat-shrink the light-shielding leader 3. If a light-shielded photosensitive material roll 6 of larger dimensions needs to be manufactured, then the shrinking tunnel 5 is required to be larger in overall size. The larger shrinking tunnel 5 needs a larger installation space therefor and results in a greater power requirement for the heater used in the shrinking tunnel 5.

In the shrinking tunnel 5, the light-shielding leader 3 and the entire photosensitive material roll 1 are heated. If the photosensitive material roll 1 is highly sensitive to heat, then the quality of the photosensitive material roll 1 tends to be adversely affected by the heat that is applied to shrink the light-shielding leader 3.

An apparatus for heating a fluid such as air and supplying the heated fluid to an object to be heated may be used to the light-shielding leader 3. Such a fluid heating and supplying apparatus is generally constructed to pass air through a heating coil to produce hot air and supply the hot air to the object to be heated. Typically, the fluid heating and supplying apparatus may be a drier or an air heater. However, these fluid heating and supplying apparatus are not designed for the purpose of producing air at such a high temperature as to be able to deform the object.

One known apparatus for heating air to a high temperature is an exhaust gas purifying apparatus for burning a particulate in the form of combustible minute particles such as soot particles discharged from a diesel engine or the like (see Japanese laid-open patent publication No. 11-264313).

As shown in FIG. 21 of the accompanying drawings, the exhaust gas purifying apparatus comprises a first tubular member 2*b* having a gas inlet 1*b* connected to the exhaust port of a diesel engine or the like, a second tubular member 3*b* disposed in the first tubular member 2*b*, a third tubular member 4*b* disposed in the second tubular member 3*b* and having a gas outlet 5*b*, and a filter 6*b* arranged in layers made of ceramics or the like and disposed in the third tubular member 4*b*. Heating coils 7*b* are wound between the first tubular member 2*b* and the second tubular member 3*b*, between the second tubular member 3*b* and third tubular member 4*b*, and between the layers of the filter 6*b*.

An exhaust gas G flowing in from the gas inlet 1*b* passes between the first tubular member 2*b* and the second tubular member 3*b* and between the second tubular member 3*b* and third tubular member 4*b*, and is heated by the heating coils 7*b*. The particulate contained in the exhaust gas G is combusted away by the heat of the heating coils 7*b*. The heated exhaust gas G is purified by the filter 6*b* and discharged out of the exhaust gas purifying apparatus.

In the exhaust gas purifying apparatus, the exhaust gas G passes through an elongate passage that is defined by the first tubular member 2*b*, the second tubular member 3*b*, and third tubular member 4*b* that are nested together. The exhaust gas G is sufficiently heated while it is flowing through the elongate passage.

However, while the exhaust gas purifying apparatus can sufficiently heat the exhaust gas G, the heat generated by the heating coils 7*b* tends to leak out of the exhaust gas purifying apparatus through the first tubular member 2*b*. Therefore, the exhaust gas purifying apparatus cannot be used in applications for heating a circuit element without thermally affecting nearby circuit elements, such as a fluid heating and supplying apparatus for preheating a circuit element.

If the exhaust gas purifying apparatus is used in an environment where a material to be shielded from light, such as a photosensitive material, is handled, then since the heating coils 7*b* are exposed through the gas outlet 5*b*, the photosensitive material may possibly be exposed to the glow produced when the heating coils 7*b* are heated. Similarly, when the temperature of the exhaust gas purifying apparatus rises, the first tubular member 2*b* itself glows, producing light to which the photosensitive material is exposed.

SUMMARY OF THE INVENTION

It is a general object of the present invention to provide a method of and apparatus for packaging a light-shielded photosensitive material roll economically and efficiently with a simple and small arrangement without adversely affecting the quality of a photosensitive material sheet of the light-shielded photosensitive material roll.

A major object of the present invention is to provide a fluid heating and supplying apparatus which, even when heated, does not adversely affect a surrounding mechanism with the produced heat.

Another major object of the present invention is to provide a fluid heating and supplying apparatus which, even when heated, does not adversely affect a surrounding mechanism including an object to be heated with the produced glow.

Still another major object of the present invention is to provide a fluid heating and supplying apparatus for efficiently heating a fluid and supplying the heated fluid to an object to be heated thereby to effectively heat the object.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
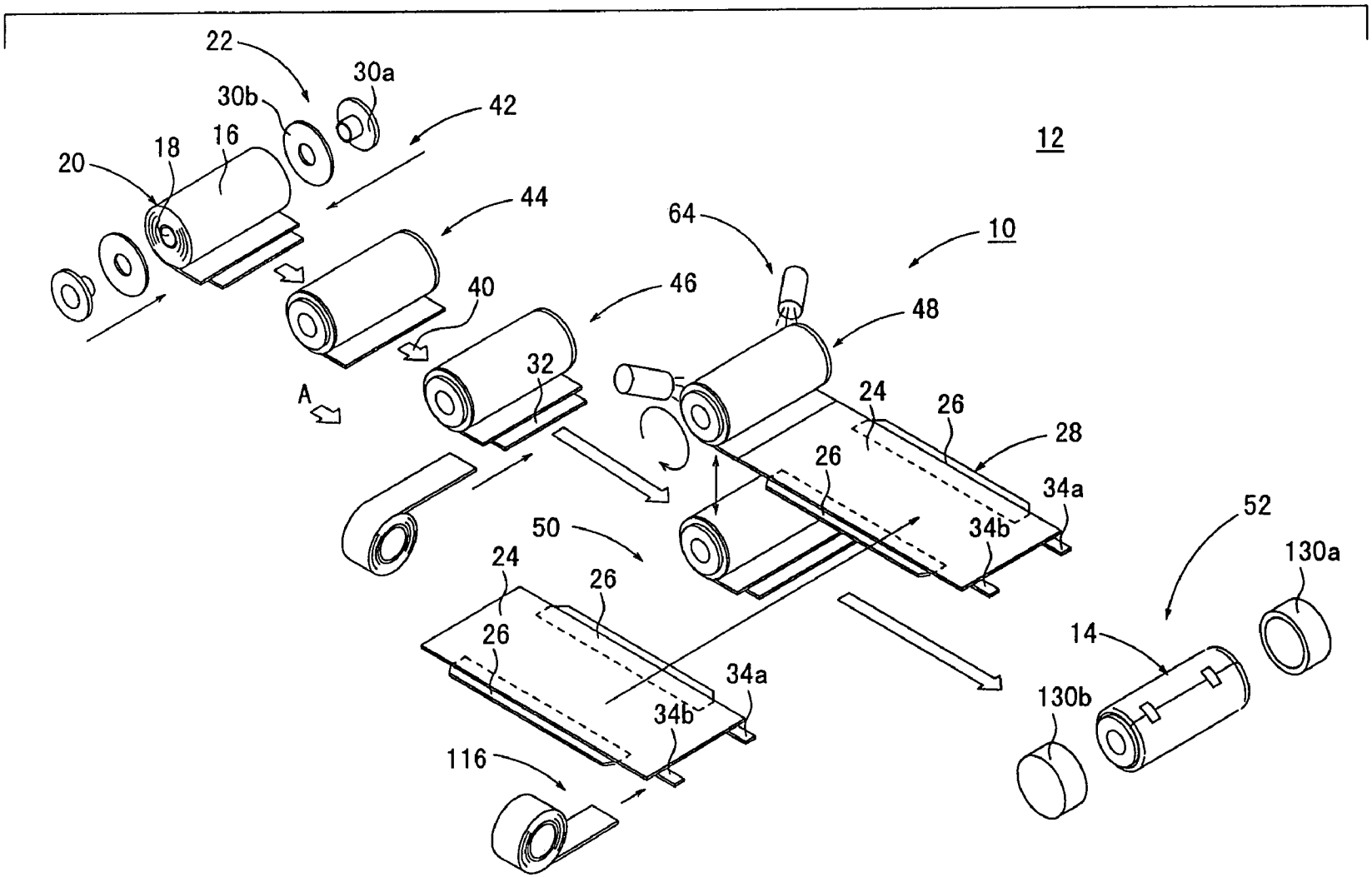
FIG. 1 is a schematic perspective view of a packaging system which incorporates an apparatus for packaging a light-shielded photosensitive material roll according to a first embodiment of the present invention.

FIG. 1 schematically shows in perspective a packaging system 12 which incorporates an apparatus 10 for packaging a light-shielded photosensitive material roll according to a first embodiment of the present invention.

As shown in FIG. 1, the light-shielded photosensitive material roll 14 comprises an elongate photosensitive material sheet 16 rolled on a core 18, providing a rolled photosensitive material sheet 20, a pair of light-shielding members 22 mounted on respective opposite ends of the rolled photosensitive material sheet 20, and a light-shielding sheet 24 wound around the rolled elongate photosensitive material sheet 20, and a pair of light-shielding shrinkable films (heat-shrinkable package members) (an object to be heated) 26 separately mounted on respective transversely opposite ends of the light-shielding sheet 24 and heat-shrunk in covering relation to outer peripheral edges of the light-shielding members 22. The light-shielding sheet 24 and the light-shielding shrinkable films 26 jointly makeup a light-shielding leader 28. The light-shielding leader 28 may alternatively be constructed of a light-shielding shrinkable film 26.

Figure 2:
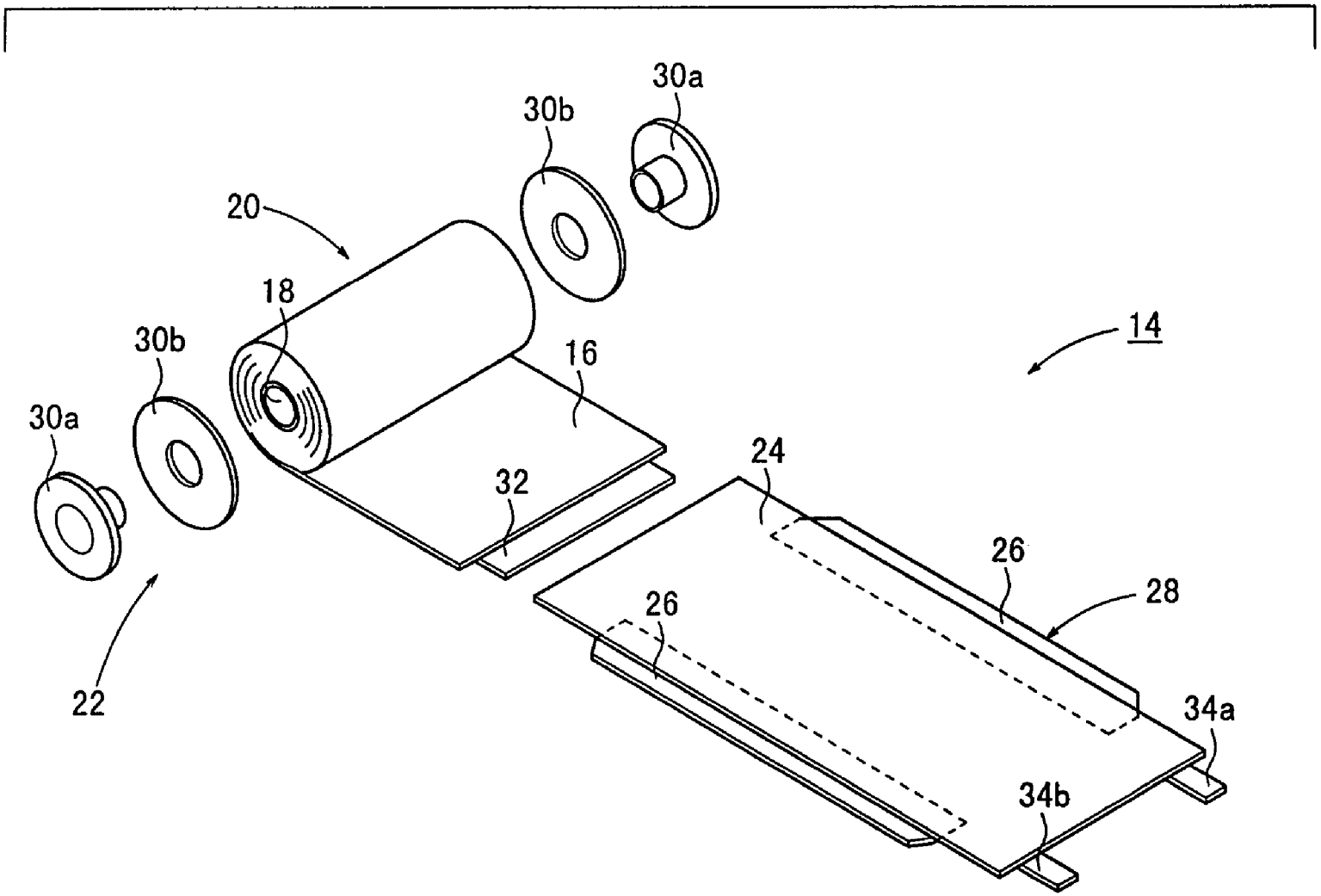
FIG. 2 is an exploded perspective view of a light-shielded photosensitive material roll to be packaged by the packaging system.
Figure 3:
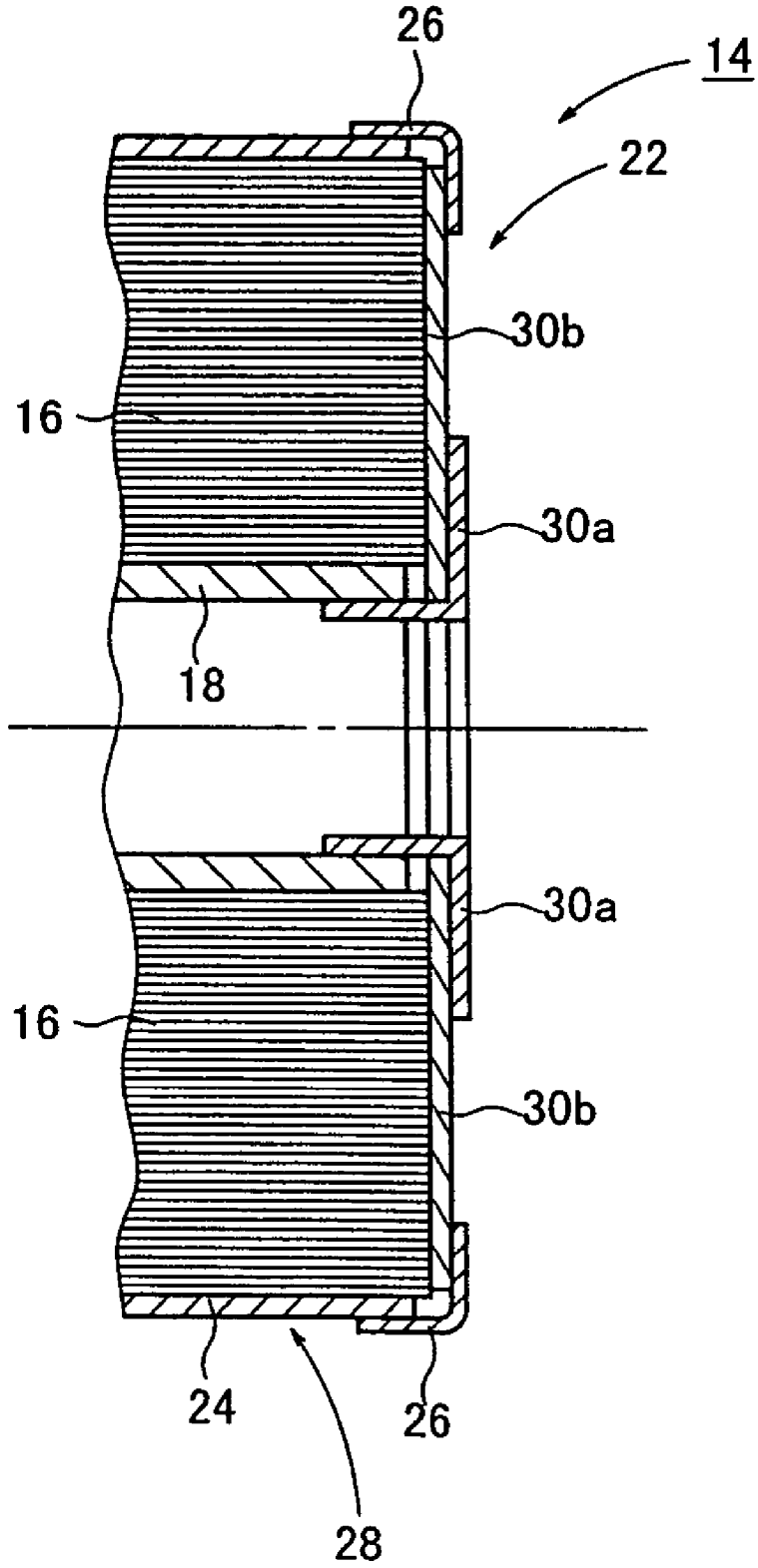
FIG. 3 is a fragmentary cross-sectional view of the light-shielded photosensitive material roll.

As shown in FIGS. 2 and 3, the light-shielding members 22 comprise respective caps 30*a* fitted in the opposite ends of the core 18, and respective rings 30*b* bonded to respective flanges of the caps 30*a*. The rings 30*b* have a diameter which is essentially the same as the diameter of the rolled photosensitive material sheet 20 (see FIG. 3). The rings 30*b* are made of a plastic material such as low-density polyethylene (PE), high-density polyethylene, PP, PET, PS, or PVC, and are coated or laminated with an adhesive such as an EVA hot-melt adhesive, polyolefin polymer alloy, or the like for bonding the caps 30*a* and the light-shielding shrinkable films 26 thereto.

In the first embodiment, each of the rings 30*b* comprises a PET base having a thickness of 100 $\mu$m, a black low-density polyethylene layer having a thickness of 40 $\mu$m and disposed on one surface of the PET base with a laminated layer of PE having a thickness of 13 $\mu$m interposed therebetween, and an adhesive layer of polyolefin polymer alloy containing 4% of carbon, the adhesive layer having a thickness of 40 $\mu$m and disposed on the other surface of the PET base with a laminated layer of PE having a thickness of 13 $\mu$m interposed therebetween. The adhesive layer has a Vicat softening point ranging from 45° C. to 60° C.

The light-shielding sheet 24 of the light-shielding leader 28 has a thickness ranging from 30 $\mu$m to 300 $\mu$m, or preferably ranging from 100 $\mu$to 250 $\mu$m. In the first embodiment, the light-shielding sheet 24 comprises a PET sheet having a thickness of 100 μm and a pair of black low-density polyethylene sheets disposed respectively on opposite surfaces of the PET sheet and each having a thickness of 40 μm, with respective extruded laminated layers each having a thickness of 15 μm interposed therebetween. The light-shielding sheet 24 has an overall thickness of 210 μm.

Each of the light-shielding shrink films 26 has a thickness ranging from 40 μm to 200 μm, or preferably ranging from 50 μm to 150 μm. In the first embodiment, each of the light-shielding shrink films 26 comprises a shrinkable PET sheet having a thickness of 25 μm and a pair of black low-density polyethylene sheets disposed respectively on opposite surfaces of the PET sheet and each having a thickness of 23 μm, with respective extruded laminated layers each having a thickness of 13 μm interposed therebetween. The light-shielding shrink film 26 has an overall thickness of 97 μm.

The light-shielding leader 28 and the photosensitive material sheet 16 are joined to each other by a joint tape 32, with end fixing tapes 34*a*, 34*b* (see FIG. 2) mounted on the leading end of the light-shielding leader 28.

As shown in FIG. 1, the packaging system 12 has a feed system 40 extending in the direction indicated by the arrow A, and includes a light-shielding member inserter 42, a roll end positioner 44, a joint tape applicator 46, a heat shrinkage and take-up unit 48, a light-shielding leader supply 50, and a heat seal bonder 52.

Figure 4:
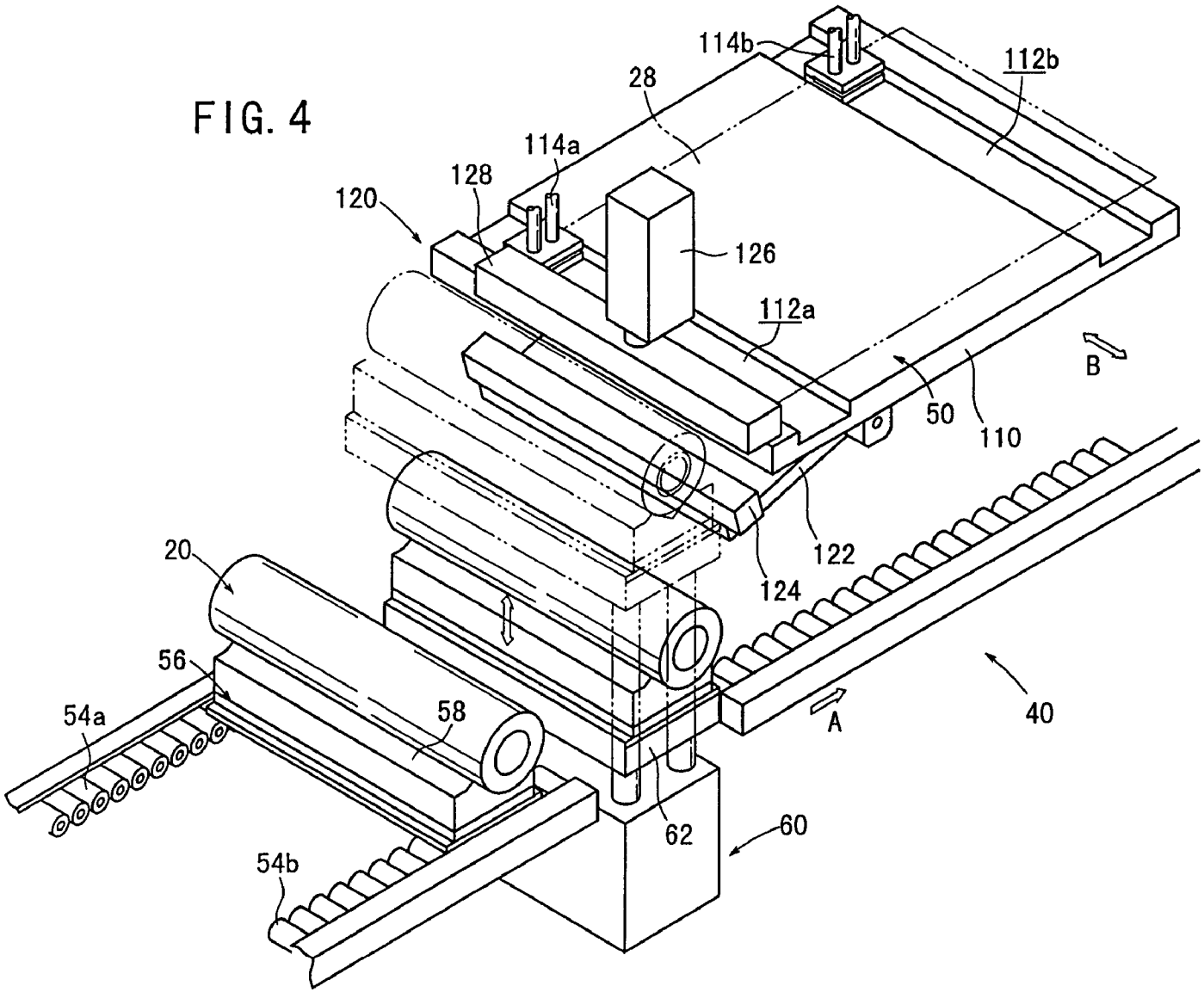
FIG. 4 is a perspective view of a feed system of the packaging system.
Figure 5:
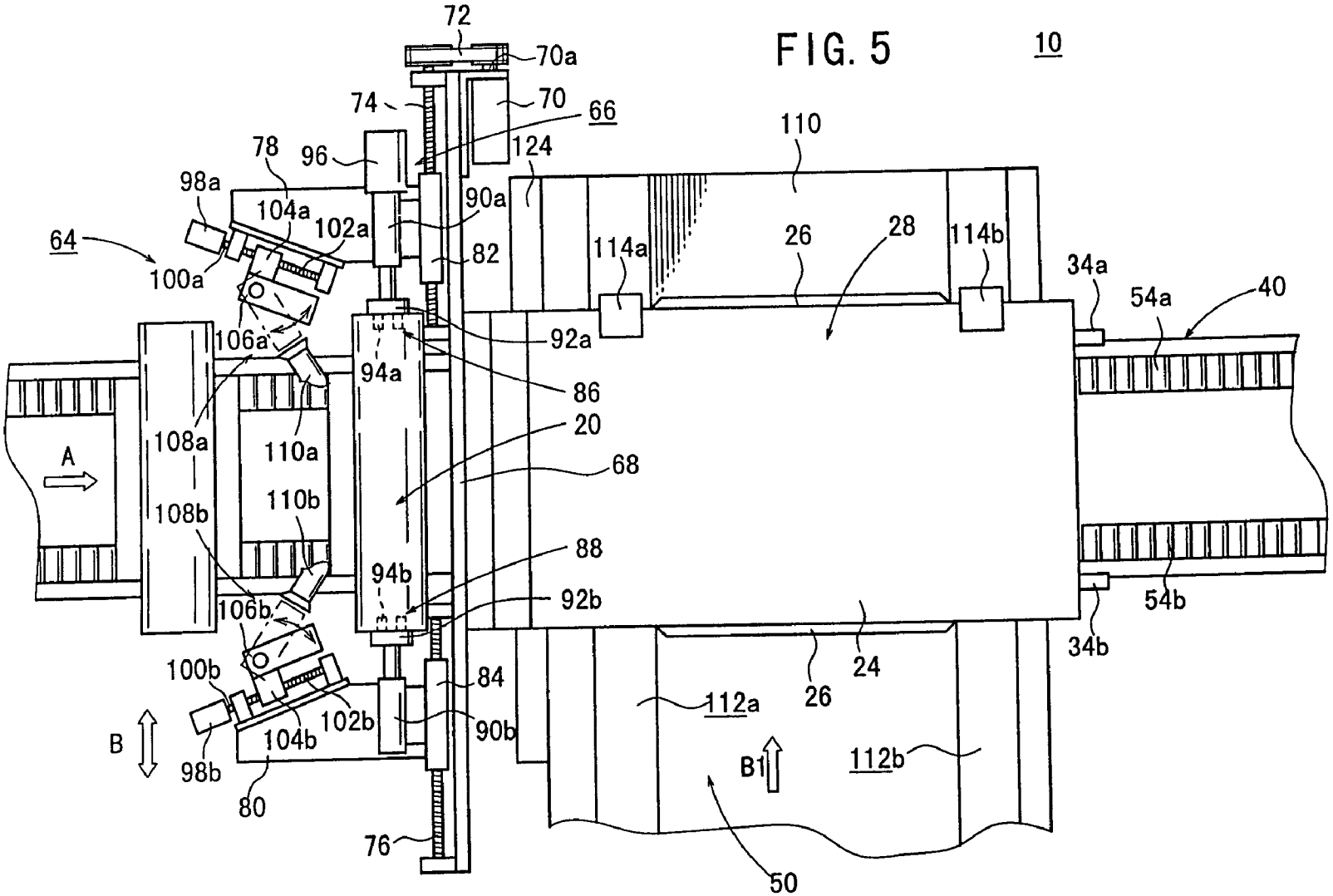
FIG. 5 is a plan view of the packaging apparatus.
Figure 6:
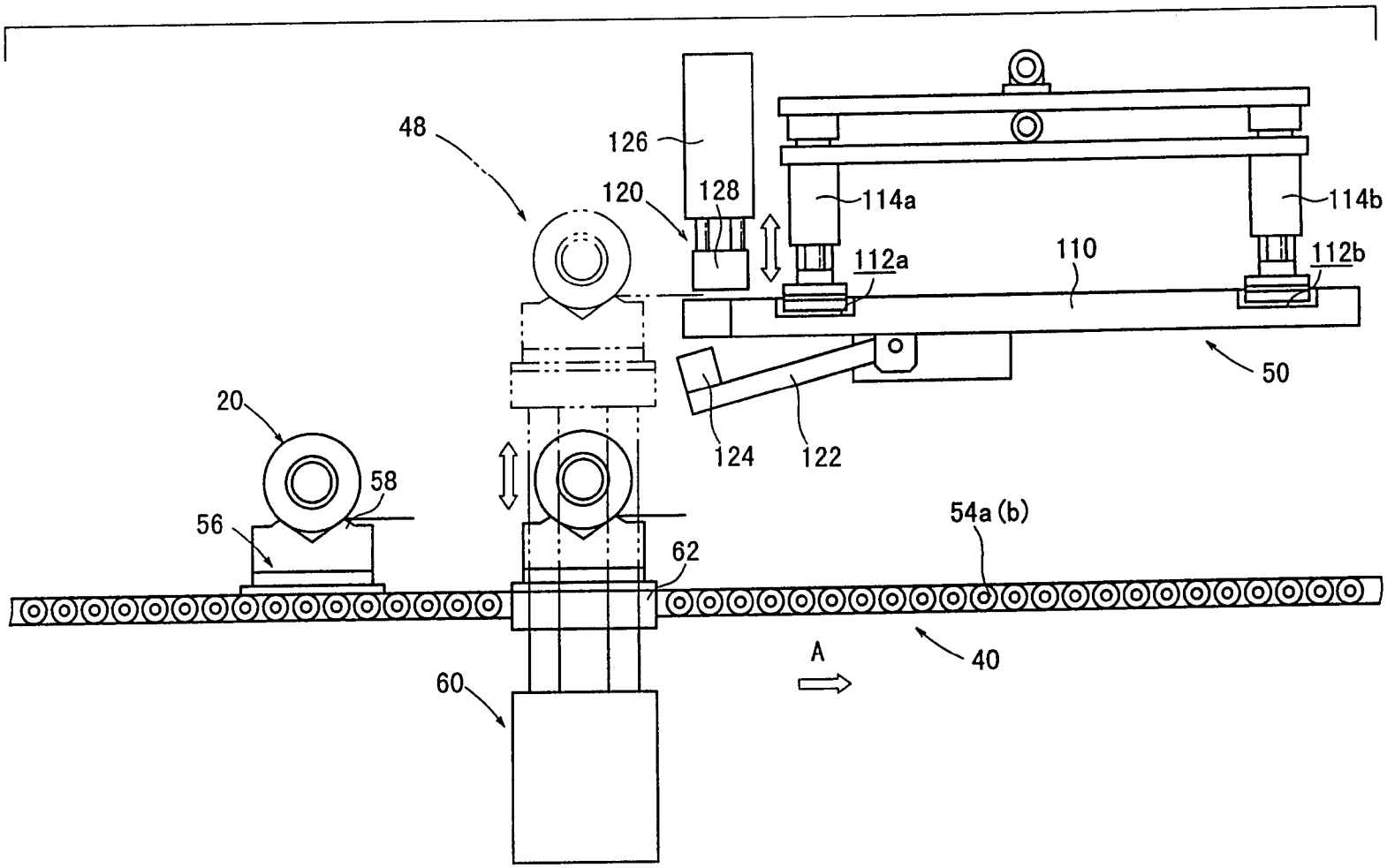
FIG. 6 is a side elevational view of the feed system and a light-shielding leader supply.

As shown in FIGS. 4 and 5, the feed system 40 has a pair of feed conveyors 54*a*, 54*b* spaced transversely from each other by a given distance and extending parallel to each other, and a pallet 56 removably disposed on the feed conveyors 54*a*, 54*b*. The pallet 56 has a holder 58 of substantially V-shaped cross section disposed on an upper surface thereof for placing the rolled photosensitive material sheet 20 thereon. As shown in FIGS. 4 and 6, a lifter 60 is disposed below the heat shrinkage and take-up unit 48. The lifter 60 is positioned between the feed conveyors 54*a*, 54*b* and has a pallet rest 62 that can be vertically moved by an actuator for positioning the pallet 56 between a position on the feed conveyors 54*a*, 54*b* and a position at the heat shrinkage and take-up unit 48.

The heat shrinkage and take-up unit 48 incorporates the packaging apparatus 10 according to the first embodiment. As shown in FIG. 5, the packaging apparatus 10 has a pair of hot air supply mechanisms (fluid heating and supplying apparatus) 64 disposed in association with the light-shielding shrinkable films 26, respectively, on the opposite sides of the light-shielding leader 28, for applying hot air locally to the light-shielding shrinkable films 26, and a drive mechanism 66 for rotating the rolled photosensitive material sheet 20 to rotate the hot air supply mechanisms 64 relatively along the outer circumference of the rolled photosensitive material sheet 20.

The packaging apparatus 10 has a base 68 extending in the directions indicated by the arrow B across the feed direction (indicated by the arrow A). A roll width changing motor 70 is mounted on an end of the base 68 and has a drive shaft 70*a* operatively coupled to an end of a first ball screw 74 by a belt and pulley means 72. The other end of the first ball screw 74 is coaxially coupled to a second ball screw 76 which has its threads oriented in the opposite direction to the threads of the first ball screw 74.

The first and second ball screws 74, 76 are threaded in respective nuts 82, 84 mounted on respective first and second movable bases 78, 80. The drive mechanism 66 comprises a pair of take-up chucks 86, 88 mounted on the first and second movable bases 78, 80, respectively. The take-up chucks 86, 88 have respective chuck units 92*a*, 92*b* movable toward and away from each other by respective cylinders 90*a*, 90*b*. The chuck units 92*a*, 92*b* have respective fingers 94*a*, 94*b* mounted on their distal ends for insertion into the core 18. The fingers 94*a*, 94*b* can be spread radially outwardly when inserted in the core 18. At least the take-up chuck 86 is combined with a motor 96 for rotating the chuck unit 92*a*.

The hot air supply mechanisms 64 have respective diameter changing motors 98*a*, 98*b* mounted respectively on the first and second movable bases 78, 80. The motors 98*a*, 98*b* have respective drive shafts 100*a*, 100*b* coaxially coupled to respective ball screws 102*a*, 102*b* rotatably supported on the first and second movable bases 78, 80 and threaded through respective nuts 104*a*, 104*b*. Heater units 106*a*, 106*b* are swingably mounted respectively on the nuts 104*a*, 104*b*.

As described later on, the heater units 106*a*, 106*b* are arranged to discharge a continuous flow of hot air at a constant rate at a content temperature from a nozzle. The heater units 106*a*, 106*b* are angularly movable between a position facing the light-shielding shrinkable films 26 on the rolled photosensitive material sheet 20 and a position spaced from the light-shielding shrinkable films 26. In the position spaced from the light-shielding shrinkable films 26, there are disposed retrieval mechanisms 108*a*, 108*b* for forcibly retrieving hot air ejected from the heater units 106*a*, 106*b*. The retrieval mechanisms 108*a*, 108*b* have respective ducts 110*a*, 110*b* which are connected to a suction source such as a vacuum source, not shown.

As shown in FIGS. 4 through 6, the light-shielding leader supply 50 has a suction table 110 extending in the directions indicated by the arrow B and having parallel grooves 112*a*, 112*b* defined in an upper surface thereof and extending in the directions indicated by the arrow B. The light-shielding leader supply 50 also has chucks 114*a*, 114*b* disposed respectively in the grooves 112*a*, 112*b* and movable back and forth along the grooves 112*a*, 112*b* in the directions indicated by the arrow B. The chucks 114*a*, 14*b* are capable of gripping a longitudinal edge of the light-shielding leader 28 at positions on the opposite sides of the light-shielding shrinkable films 26. As shown in FIG. 1, an applicator 116 for bonding the end fixing tapes 34*a*, 34*b* to the leading end of the light-shielding sheet 24 in the direction indicated by the arrow A is disposed upstream of the light-shielding leader supply 50.

A joining and holding mechanism 120 is disposed on the trailing end of the suction table 110 in the direction indicated by the arrow A at a position where the photosensitive material sheet 16 and the light-shielding leader 28 are to be joined to each other. As shown in FIGS. 4 and 6, the joining and holding mechanism 120 has a swing arm 122 disposed on an outer side (lower side) of the photosensitive material sheet 16 and the light-shielding leader 28 and swingably supported by an actuator, not shown. A joint suction box 124 extending in the directions indicated by the arrow B is mounted on the distal end of the swing arm 122. The joint suction box 124 is connected to a suction source, not shown. A holder 128 that is vertically movable by a cylinder 126 is disposed on an inner side (upper side) of the photosensitive material sheet 16 and the light-shielding leader 28. The holder 128 is disposed in a position for pressing a joint of the rolled photosensitive material sheet 20 in coaction with the joint suction box 124.

The heat seal bonder 52 has a pair of ring heaters (heating mechanism) 130*a*, 130*b* positioned on the opposite ends of the light-shielded photosensitive material roll 14.

Figure 7:
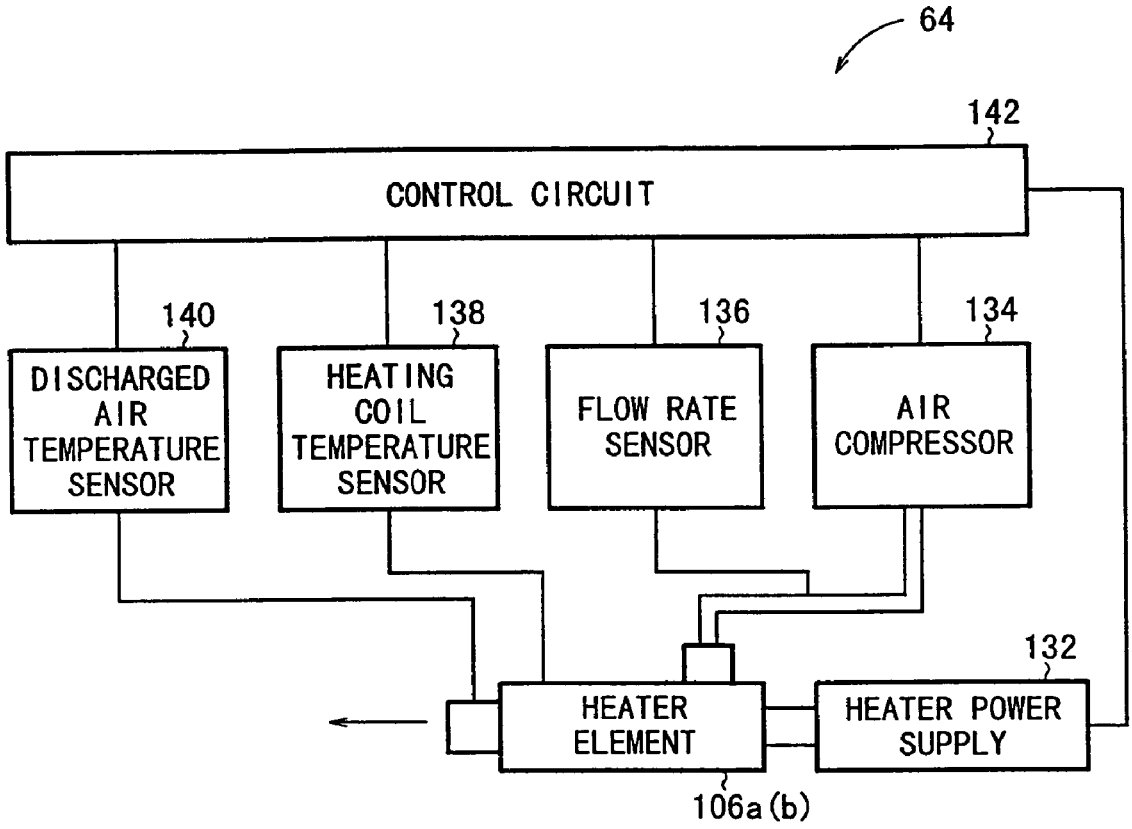
FIG. 7 is a block diagram of a fluid heating and supplying apparatus according to an embodiment of the present invention.

FIG. 7 shows in block form the hot air supply mechanisms 64. As shown in FIG. 7, the hot air supply mechanisms 64 comprise the heater units 106*a*, 106*b*, a heater power supply 132 for energizing the heater units 106*a*, 106*b*, an air compressor 134 for supplying air to the heater units 106*a*, 106*b*, a flow rate sensor 136 for detecting the rate of air that is supplied, a heating coil temperature sensor 138 for detecting the temperature of heating coils, described below, that are disposed in the heater units 106*a*, 106*b*, a discharged air temperature sensor 140 for detecting the temperature of air discharged from the heater units 106*a*, 106*b*, and a control circuit 142 for controlling the heater power supply 132 and the air compressor 134 based on signals from the flow rate sensor 136, the heating coil temperature sensor 138, and the discharged air temperature sensor 140.

Figure 8:
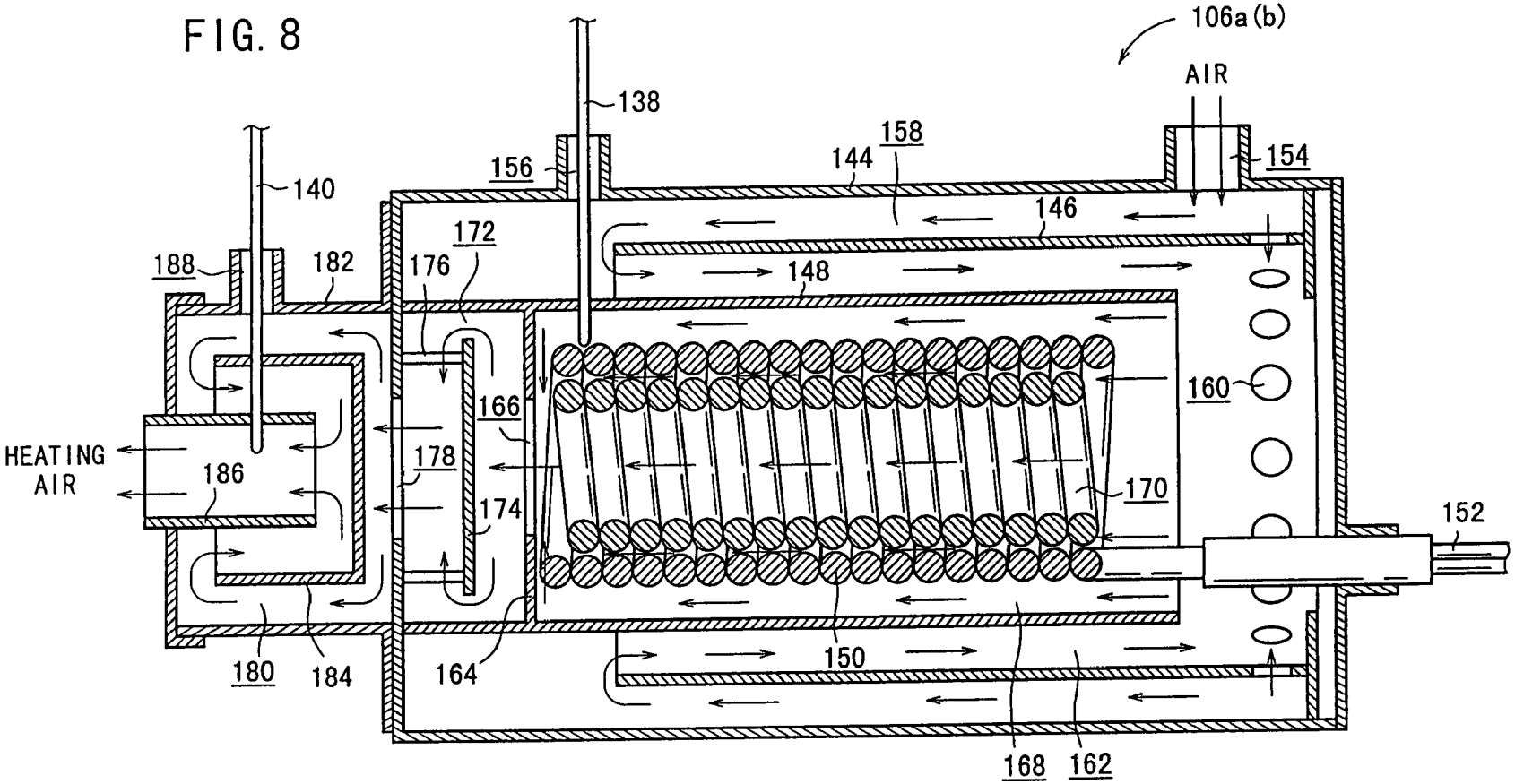
FIG. 8 is a cross-sectional view of a heater unit of the fluid heating and supplying apparatus.

FIG. 8 shows in cross section the heater units 106*a*, 106*b*. As shown in FIG. 8, each of the heater units 1061, 106*b* comprises a cylindrical outer casing 144, a first cylindrical inner casing 146 disposed in the cylindrical outer casing 144, and a second cylindrical inner casing 148 disposed in the first cylindrical inner casing 146. Each of the heater units 106*a*, 106*b* also has a heating coil (heating body) 150 arranged in two helical layers. The heating coil 150 is connected to a lead 152 extending out of the heater units 106*a*, 106*b* through an end of the outer casing 144 and electrically connected to the heater power supply 132.

The outer casing 144 has an air inlet 154 defined in an outer circumferential wall near the end through which the lead 152 extends, for being supplied with air from the air compressor 134. The outer casing 144 also has a sensor insertion hole 156 defined in an outer circumferential wall near the opposite end, for inserting therethrough the heating coil temperature sensor 138. The heating coil temperature sensor 138 inserted through the sensor insertion hole 156 has a tip end extending radially through the second inner casing 148 toward the heating coil 150. A first passage 158 for passing air therethrough in the longitudinal direction of the outer casing 144 is defined between the inner circumferential surface of the outer casing 144 and the outer circumferential surface of the first inner casing 146.

The first inner casing 146 has a plurality of circumferentially spaced holes 160 defined in an end thereof near the air inlet 154. The first inner casing 146 extends to a position near the sensor insertion holes 156 of the outer casing 144. A second passage 162 communicating with the first passage 158 is defined between the inner circumferential surface of the first inner casing 146 and the outer circumferential surface of the second inner casing 148.

The second inner casing 148 is connected to an inner surface of the other end of the outer casing 144 remote from the air inlet 154, and has a radial partition 164 near the heating coil temperature sensor 138 at one end of the heating coil 150. The partition 164 has a central hole 166 defined therein. A third passage 168 communicating with the second passage 162 is defined between the inner circumferential surface of the second inner casing 148 and the outer circumferential surface of the heating coil 150. A fourth passage 170 communicating with the central hole 166 is defined centrally in the heating coil 150.

A first light-shielding chamber 172 is defined between the partition 164 of the second inner casing 148 and the other end of the outer casing 144. A light-shielding plate 174 having a diameter greater than the diameter of the hole 166 and smaller than the inside diameter of the second inner casing 148 is disposed centrally in the first light-shielding chamber 172 and supported on the other end of the outer casing 144 by ribs 176.

The other end of the outer casing 144 has a central hole 178 defined therein in communication with the first light-shielding chamber 172. A second light-shielding chamber 180 is defined on the outer surface of the other end of the outer casing 144 in communication with the hole 178. The second light-shielding chamber 180 has an outer casing 182 joined to the outer casing 144, an inner casing 184 disposed in the outer casing 182, and a nozzle 186 disposed in the inner casing 184.

The inner casing 184 is in the form of a bottomed hollow cylinder and has a bottom whose diameter is greater than the diameter of the hole 178 in communication with the first light shielding chamber 172. The nozzle 186 disposed in the inner casing 184 is in the form of a hollow cylinder. The outer casing 182 has a sensor insertion hole 188 defined in its circumferential wall, and the discharged air temperature sensor 140 extends radially through the sensor insertion hole 188 and has an inner tip extending through the inner casing 184 and the nozzle 186 toward a central region of the nozzle 186.

Operation of the packaging system 12 thus constructed will be described below.

The rolled photosensitive material sheet 20 of the photosensitive material sheet 16 rolled on the core 18 is placed on the pallet 56 of the feed system 50. The feed conveyors 54*a*, 54*a* are operated to feed the rolled photosensitive material sheet 20 in the direction indicated by the arrow A to the light-shielding member inserter 42. In the light-shielding member inserter 42, as shown in FIG. 1, the light-shielding members 22 are applied to the respective opposite ends of the core 18. Thereafter, the pallet 56 is delivered to the roll end positioner 44 in which the ends of the rolled photosensitive material sheet 20 are positioned.

Then, the rolled photosensitive material sheet 20 on the pallet 56 is sent to the joint tape applicator 46 where the joint tape 32 is applied to the end of the photosensitive material sheet 16. As shown in FIGS. 4 and 6, when the rolled photosensitive material sheet 20 with the joint tape 32 applied thereto is positioned below the heat shrinkage and take-up unit 48, the lifter 60 is actuated to lift the pallet rest 62 between the feed conveyors 54*a*, 54*b*, elevating the pallet 56 on which rolled photosensitive material sheet 20 is placed, off the feed conveyors 54*a*, 54*b*.

The end fixing tapes 34*a*, 34*b* have been applied to the leading end of the light-shielding sheet 24 in the direction indicated by the arrow A in the applicator 116. The light-shielding sheet 24 is gripped by the chucks 114*a*, 114*b* and delivered in the direction indicated by the arrow B1 to a joining position. The light-shielding sheet 24 has a width which is substantially the same as the width of the photosensitive material sheet 16 and a length equal to or greater than the length of one turn of the rolled photosensitive material sheet 20. The light-shielding shrinkable films 26 applied to the opposite sides of the light-shielding sheet 24 project laterally outwardly from the opposite sides of the light-shielding sheet 24 by a length ranging from 3 mm to 15 mm, preferably from 5 mm to 10 mm, and have a length equal to or greater than the length of one turn of the rolled photosensitive material sheet 20.

In the heat shrinkage and take-up unit 48, an end of the light-shielding sheet 24 is positioned over the joint tape 32 which is bonded to the end of the photosensitive material sheet 16. The joining and holding mechanism 120 is now actuated to swing the joint suction box 124 upwardly toward the end of the rolled photosensitive material sheet 20 and the joint tape 32. While the end of the rolled photosensitive material sheet 20 and the joint tape 32 are being drawn under suction by the joint suction box 124, the holder 128 is lowered toward the joint suction box 124. The joint suction box 124 and the holder 128 coact with each other to join the end of the light-shielding sheet 24 to the joint tape 32.

After the end of the rolled photosensitive material sheet 20 is joined to the light-shielding leader 28 by the joint tape 32, the cylinders 90*a*, 90*b* are actuated to displace the take-up chucks 86, 88 toward each other until the chuck units 92*a*, 92*b* engage in the core 18. As shown in FIG. 5, the fingers 94*a*, 94*b* are inserted into the core 18, and then spread radially outwardly to hold the inner circumferential surface of the core 18, whereupon the motor 96 is energized. In the hot air supply mechanisms 64, the heater units 106*a*, 106*b* have been displaced from the position facing the retrieval mechanisms 108*a*, 108*b* to the position facing the opposite edges of the rolled photosensitive material sheet 20, i.e., the light-shielding shrinkable films 26. As shown in FIG. 7, the control circuit 142 actuates the air compressor 134 to supply air to the heater units 106*a*, 106*b*, and causes the heater power supply 132 to energize the heating coils 150 of the heater units 106*a*, 106*b*.

The air supplied from the air compressor 134 is adjusted in its rate by the control circuit 142 based on a signal from the flow rate sensor 136, and flows from the air inlet 154 in the outer casing 144 into the heater units 106*a*, 106*b*. As shown in FIG. 8, the air passes through the first passage 158 between the inner circumferential surface of the outer casing 144 and the outer circumferential surface of the first inner casing 146, then through the second passage 162 between the inner circumferential surface of the first inner casing 146 and the outer circumferential surface of the second inner casing 148, and then flows into the third passage 158 and the fourth passage 170 in the second inner casing 148. A portion of the air supplied from the air inlet 154 is supplied directly into the third passage 168 and the fourth passage 170 via the holes 160 that are defined in the first inner casing 146.

The air supplied into the second inner casing 148 is heated into heating air by the heat generated by the heating coil 150 while passing through the third passage 168 and the fourth passage 170.

At this time, the air is preheated by radiant heat supplied from the second inner casing 148 while passing through the second passage 162, and thereafter is efficiently heated when passing through the third passage 168 and the fourth passage 170. Since the heating coil 150 for heating air is arranged in two helical layers, it is capable of applying a sufficient amount of heat to the air. Therefore, the heater units 106*a*, 106*a* are not required to be unduly elongate, but may be reduced in size.

The first passage 158 is defined radially outwardly of the second passage 162 which preheats the air. Consequently, the heat generated by the heating coil 150 is sufficiently blocked by the air passing through the first passage 158 against the transfer out of the heater units 106*a*, 106*b*. Therefore, any heat radiation from the outer casing 144 does not tend to adversely affect the rolled photosensitive material sheet 20 and other members and regions outside of the heater units 106*a*, 106*b*. The heater units 106*a*, 106*b* are not required to employ any special heat insulating materials. The outer casing 144 may be made of stainless steel, ceramics, or the like.

The air thus heated is supplied via the central hole 166 in the partition 164 into the first light-shielding chamber 172. The air supplied into the first light-shielding chamber 172 the n changes its direction by about 90° due to the light-shielding plate 174, and then flows around the light-shielding plate 174 and is supplied via the hold 178 into the second light-shielding chamber 180. In the second light-shielding chamber 180, the air changes its direction by about 90° due to the bottom of the inner casing 184, flows into the inner casing 184, and is then discharged out through the nozzle 186.

While the take-up chucks 86, 88 are being rotated, the light-shielding leader 28 is wound around the rolled photosensitive material sheet 20, and the hot air (heating air) is ejected locally to the light-shielding shrinkable films 26 of the light-shielding leader 28. When exposed to the hot air, the light-shielding shrinkable films 26 are heat-shrunk in covering relation to the outer edges of the light-shielding members 22.

The heating air applied to the light-shielding shrinkable films 26 is discharged from the heating units 106*a*, 106*b* via the first and second light-shielding chambers 172, 180 which provide a labyrinth air passageway. Therefore, even if the heating coils 150 glow when heated, the glow is not emitted through the nozzle 186. As a result, a dark chamber in which the rolled photosensitive material sheet 20 is manufactured is well protected against entry of unwanted light.

The nozzle 186 may be adjusted in shape to apply the heating air only to the light-shielding shrinkable films 26. Therefore, the emulsion of the photosensitive material sheet 16 is prevented from being heated and thermally fogged by the heat of the heating air.

Inner wall surfaces of the first and second light-shielding chambers 172, 180 may be coated with a heat-resistant black flat paint layer such as of titanium ceramic resin or ceramic coating, or machined with shot peening or rough grinding to provide roughened surfaces for more effectively preventing the glow of the heating coil 150 from leaking out of the nozzle 186.

The temperature of the heating air discharged from the nozzle 186 is detected by the discharged air temperature sensor 140 whose tip end is disposed in the nozzle 186, and fed back to the heater power supply 132 by the control circuit 142 for thereby setting the heating air to an accurate temperature. Inasmuch as the rate of heating air that is discharged is monitored by the flow rate sensor 136 at all times, the temperature of the heating air does not fluctuate due to flow rate variations. As a result, it is possible for the heater units 106*a*, 106*b* to produce heating air at a constant temperature.

The heating coil temperature sensor 138 whose tip end is positioned near the heating coil 150 monitors the temperature of the surface of the heating coil 150. When the heating coil temperature sensor 138 detects an overheated state of the heating coil 150, the control circuit 142 cuts off the current supplied from the heater power supply 132 for thereby preventing the air or the heater units 106*a*, 106*b* from being overheated.

The heater units 106*a*, 106*b* should preferably be changed in their position immediately before the leading ends of the light-shielding shrinkable films 26 are wound around the rolled photosensitive material sheet 20.

Immediately after the trailing ends of the light-shielding shrinkable films 26 are wound around the rolled photosensitive material sheet 20, the heater units 106*a*, 106*b* are displaced to a pre-packaging position, i.e., the position facing the retrieval mechanisms 108*a*, 108*b*. After the trailing end of the light-shielding leader 28 is wound around the rolled photosensitive material sheet 20, the trailing end of the light-shielding leader 28 is fixed in position by the end fixing tapes 34*a*, 34*b*, and the motor 96 is de-energized.

Figure 9:
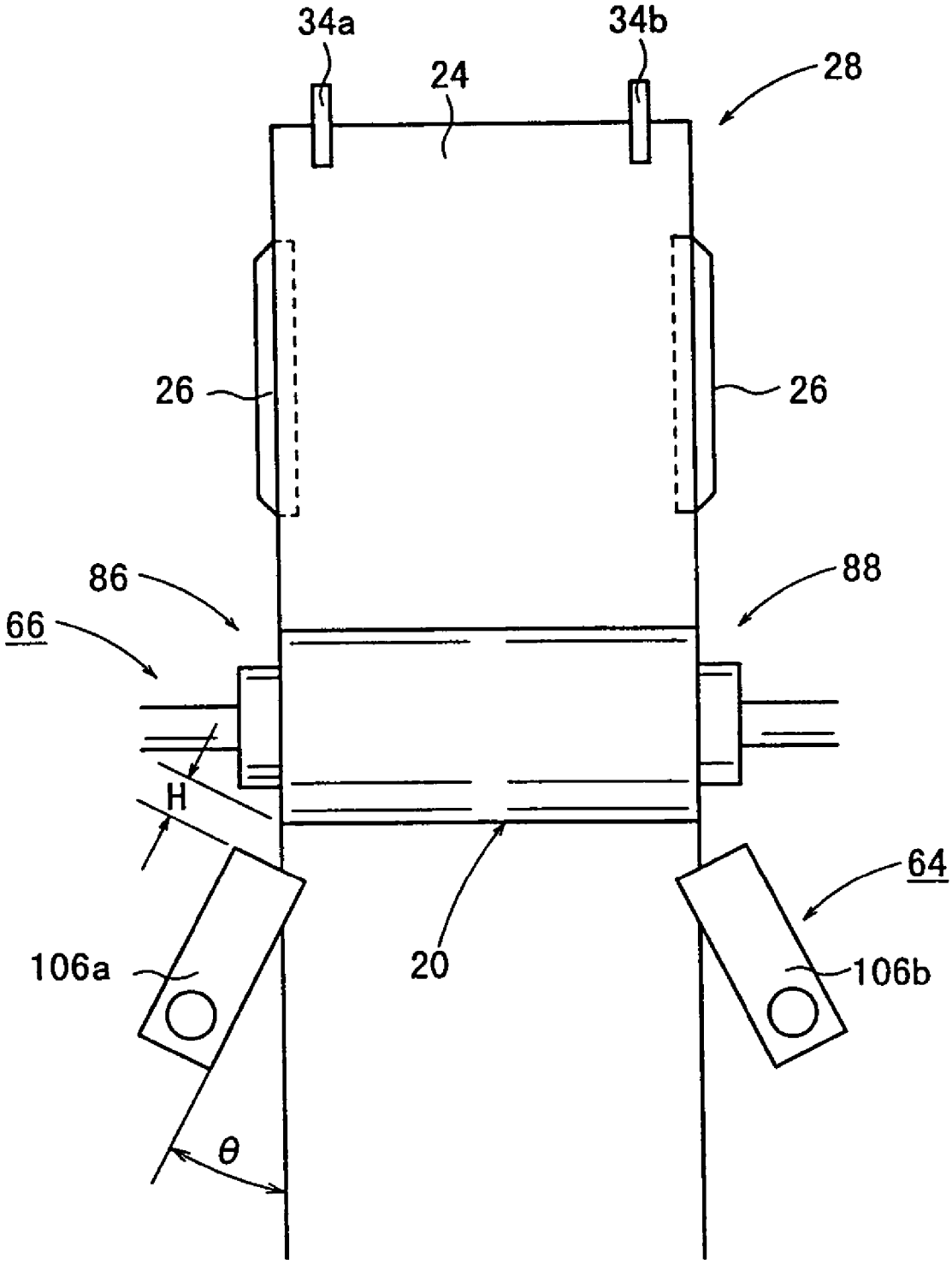
FIG. 9 is a view illustrative of a distance and an angle of a hot air applicator of the packaging apparatus.

As shown in FIG. 9, the conditions including the temperature and flow rate of the hot air to heat-shrinking the light-shielding shrinkable films 26 are different depending on the distance H from the nozzle ends of the heating units 106*a*, 106*b* to the rolled photosensitive material sheet 20, the angle q at which the hot air is applied, and the rotational speed of the rolled photosensitive material sheet 20, i.e., the speed at which the light-shielding leader 28 is wound on the rolled photosensitive material sheet 20.

The distance H from the heating units 106*a*, 106*b* to the rolled photosensitive material sheet 20 is preferably selected such that the nozzle ends of the heating units 106*a*, 106*b* are as close to the rolled photosensitive material sheet 20 and the light-shielding shrinkable films 26 as possible, but kept out of contact with the rolled photosensitive material sheet 20 and the light-shielding shrinkable films 26. As indicated by the following table 1, the distance H is set to a value lower than 15 mm. The angle q at which the hot air is applied is selected to fall in a range from 0° to 90°, preferably from 0° to 30°, with respect to the side of the rolled photosensitive material sheet 20, as indicated by the following table 2.

| DISTANCE H (mm) | RESULT OF SHRINKAGE |
|---|---|
| 3 | ○ |
| 5 | ○ |
| 10 | ○ |
| 15 | Δ |
| 20 | X |

| ANGLE (°) | RESULT OF SHRINKAGE |
|---|---|
| 0 | ○ |
| 15 | ◎ |
| 30 | ○ |
| 45 | Δ |
| 60 | Δ |
| 90 | ▲ |

Figure 10:
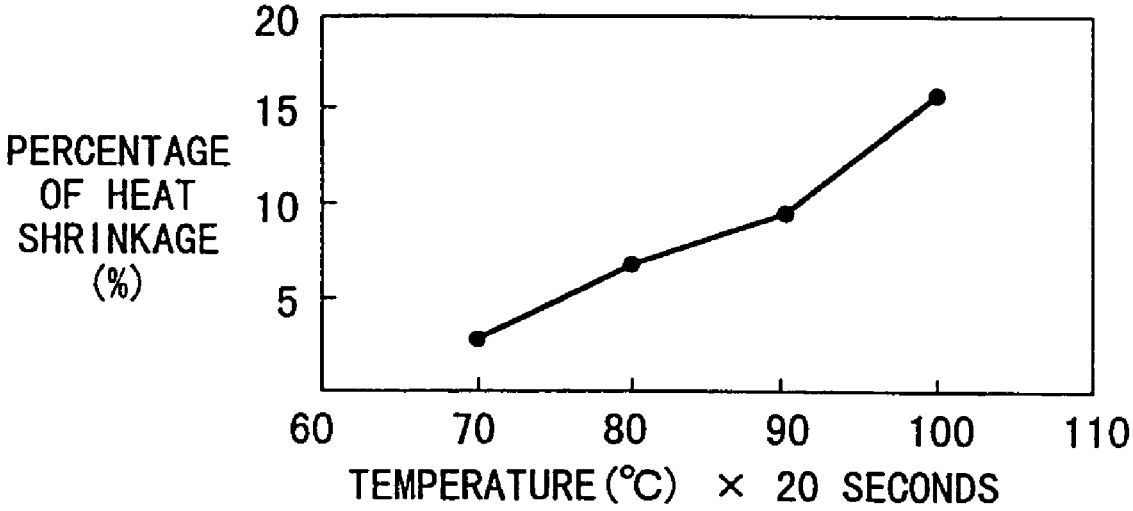
FIG. 10 is a diagram showing heat shrinking characteristics of a light-shielding shrinkable film of the light-shielded photosensitive material roll.
Figure 11:
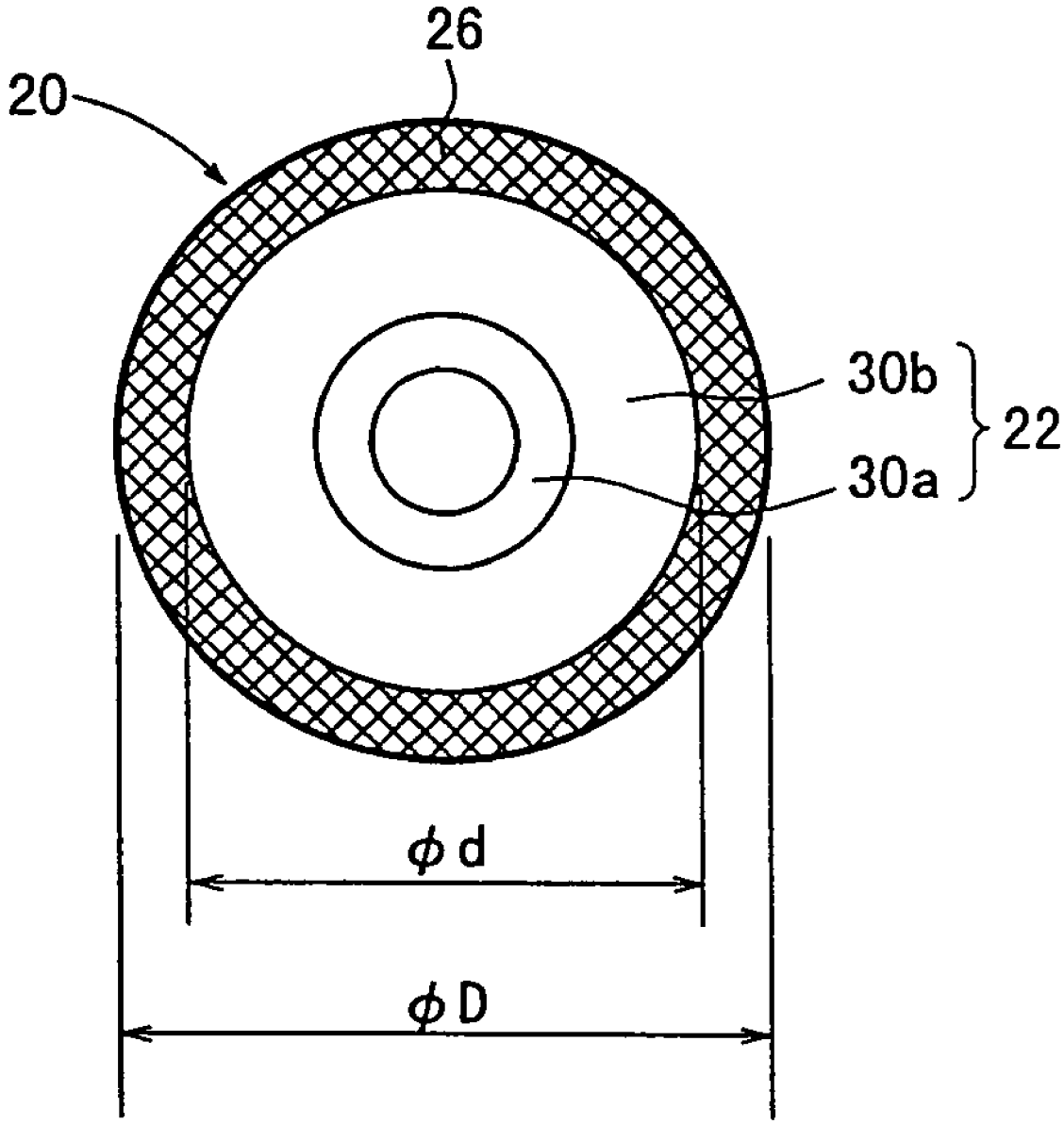
FIG. 11 is a view illustrative of a diameter change of the light-shielding shrinkable film after it has been shrunk with heat.

The light-shielding shrinkable films 26 have heat shrinkage characteristics as shown in FIG. 10. When the light-shielding shrinkable films 26 are heat-shrunk by the heater units 106*a*, 106*b*, the amount of heat required to be applied, i.e., the temperature of the hot air, the rate of the hot air, the time in which the hot air is to be applied, and the distance from the nozzle ends, varies depending on the percentage of heat shrinkage to be achieved by the light-shielding shrinkable films 26 in a packaging form. Specifically, as shown in FIG. 11, if the outside diameter D of the rolled photosensitive material sheet 20 is D=120 mm and the diameter d of the heat-shrunk light-shielding shrinkable films 26 is d=105 mm, then the percentage of heat shrinkage is given by:

$$(120-105)/120\times100=12.5\%$$

It can be seen from FIG. 10 that the amount of heat corresponding to 95° C.'20 seconds may be applied.

If the distance H from the from the nozzle ends of the heating units 106*a*, 106*b* to the rolled photosensitive material sheet 20 is H=10 mm, the angle q at which the hot air is applied is q=25°, the speed at which the light-shielding leader 28 is wound is 12 m/min., the rate of hot air discharged from the heater units 106*a*, 106*b* is about 200 l/min., and the temperature of the hot air is about 280° C., then the light-shielding shrinkable films 26 can be heat-shrunk to package the rolled photosensitive material sheet 20 appropriately.

In the first embodiment, as shown in FIG. 5, the heater units 106*a*, 106*b* of the hot air supply mechanisms 64 are positioned in association with the light-shielding shrinkable films 26 of the light-shielding leader 28 wound around the rolled photosensitive material sheet 20. While the rolled photosensitive material sheet 20 is being rotated by the drive mechanism 66, hot air can be ejected from the heater units 106*a*, 106*b* locally to the heater units 106*a*, 106*b* for thereby reliably and efficiently heat-shrinking the light-shielding shrinkable films 26.

The packaging apparatus 10 is much smaller in size than the conventional shrinking tunnel, allowing light-shielded photosensitive material rolls to be packaged in a smaller space. The heater capacity of the heater units 106*a*, 106*b* is smaller than the heater capacity of the conventional shrinking tunnel. Specifically, the heater of the conventional shrinking tunnel consumes 6 kW more, whereas the heater units 106*a*, 106*b* consume 2.4 kW. Therefore, the power requirement of the heater units 106*a*, 106*b* is effectively reduced as compared with the conventional shrinking tunnel. Since hot air is ejected from the heater units 106*a*, 106*b* locally to only the light-shielding shrinkable films 26, the rolled photosensitive material sheet 20 itself is prevented from being degraded even if it is highly sensitive to heat.

The heater units 106*a*, 106*b* are positioned in facing relation to the retrieval mechanisms 108*a*, 108*b* when heater units 106*a*, 106*b* do not heat shrink the light-shielding shrinkable films 26. The heater units 106*a*, 106*b* operate to heat supplied air with the heating coils and supply the hot air continuously eject hot air at a constant temperature and a constant rate from the nozzle ends. When heater units 106*a*, 106*b* do not heat shrink the light-shielding shrinkable films 26, the hot air ejected from the heater units 106*a*, 106*b* is forcibly retrieved by the ducts 110*a*, 110*b* of the retrieval mechanisms 108*a*, 108*b* thereby to effectively prevent the ambient temperature from unduly rising and also prevent the hot air from being applied to the rolled photosensitive material sheet 20.

The packaging apparatus according to the first embodiment is capable of easily adapting itself to different widths and diameters of the rolled photosensitive material sheet 20. Specifically, when the rolled photosensitive material sheet 20 has a different width, as shown in FIG. 5, the motor 70 is energized to rotate the first ball screw 74 that is connected to the drive shaft 70*a* via the belt and pulley means 72, rotating the second ball screw 76 that is coaxially connected to the first ball screw 74.

Since the first and second balls screws 74, 76 are threaded in the opposite directions, the nuts 82, 84 threaded over the first and second balls screws 74, 76 move toward or away from each other. The first and second movable bases 78, 90 fixed to the nuts 82, 84 change the positions of the heater units 106*a*, 106*b* in the directions indicated by the arrow B to adapt themselves to the different width of the rolled photosensitive material sheet 20.

If the rolled photosensitive material sheet 20 has a different diameter, the motors 98*a*, 98*b* of the hot air supply mechanisms 64 are energized to rotate the ball screws 102*a*, 102*b*, causing the nuts 104*a*, 104*b* to move the heater units 106*a*, 106*b* back and forth along the ball screws 102*a*, 102*b*. Therefore, the positions of the heater units 106*a*, 106*b* can be adjusted to adapt themselves to the different diameter of the rolled photosensitive material sheet 20.

After the light-shielding leader 28 is wound around the rolled photosensitive material sheet 20 by the heat shrinkage and take-up unit 48 and the end of the light-shielding leader 28 is fixed by the end fixing tapes 34*a*, 34*b*, the take-up chucks 86, 88 of the drive mechanism 66 are displaced away from each other by the cylinders 90*a*, 90*b*, moving the chuck units 92*a*, 92*b* away from the core 18. Then, the pallet rest 62 of the lifter 60 is lowered to bring the pallet 56 on the pallet rest 62 onto the feed conveyors 54*a*, 54*b*.

The pallet 56 is then delivered to the heat seal bonder 52 by the feed conveyors 54*a*, 54*b*, and the light-shielding shrinkable films 26 are bonded to the light-shielding members 22 by the ring heaters 130*a*, 130*b* of the heat seal bonder 52. The light-shielding shrinkable films 26 are bonded under heat sealing conditions that vary depending on the thickness and materials of the light-shielding shrinkable films 26. For example, if the light-shielding shrinkable films 26 have a thickness ranging from 100 $\mu$m to 150 $\mu$m and are constructed of low-density polyethylene laminated by an extrusion process on the opposite surfaces of a PET base, then the ring heaters 130*a*, 130*b* are heated at a temperature of 130° C. to heat-seal the light-shielding shrinkable films 26 for a period of time ranging from 3 seconds to 5 seconds.

Figure 12:
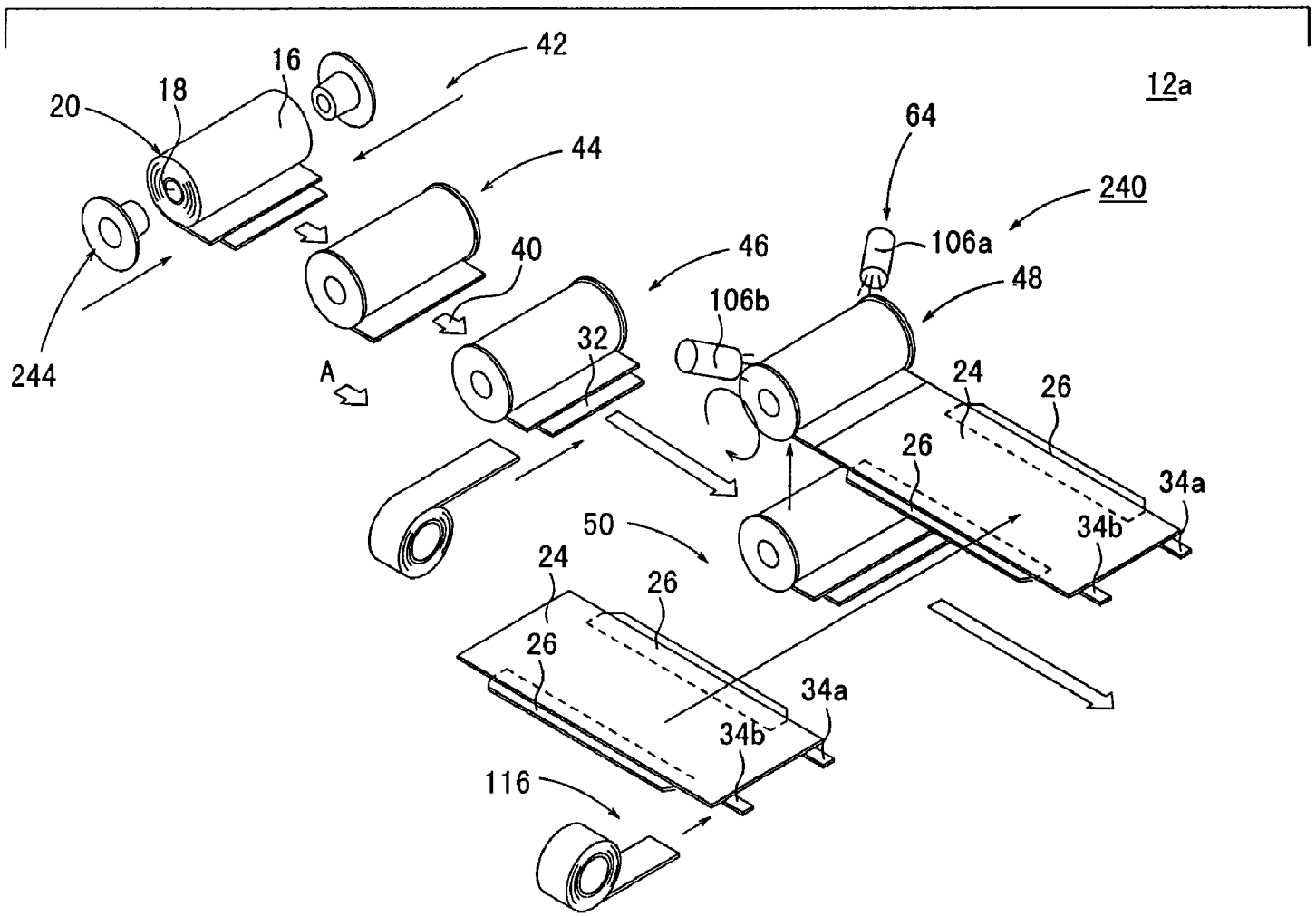
FIG. 12 is a schematic perspective view of a packaging system which incorporates a packaging apparatus according to a second embodiment of the present invention.

FIG. 12 schematically shows in perspective a packaging system 12*a* which incorporates a packaging apparatus 240 according to a second embodiment of the present invention. Those parts of the packaging system 12*a* which are identical to those of the first embodiment are denoted by identical reference characters, and will not be described in detail below.

Figure 13:
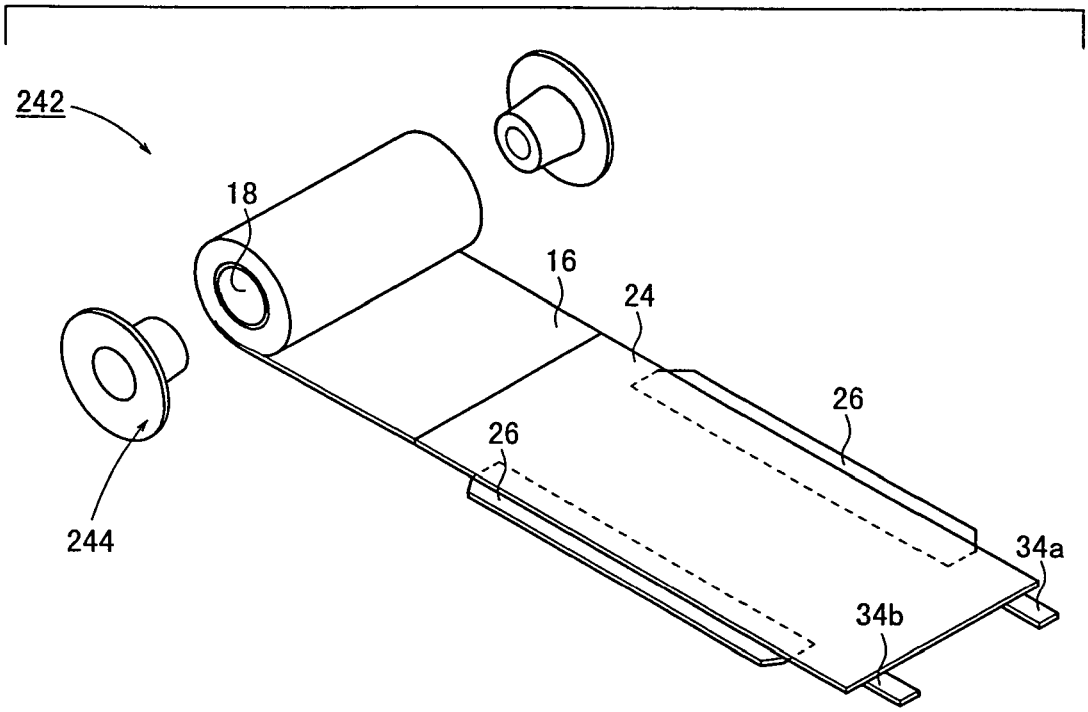
FIG. 13 is an exploded perspective view of a light-shielded photosensitive material roll to be packaged by the packaging system shown in FIG. 12.
Figure 14:
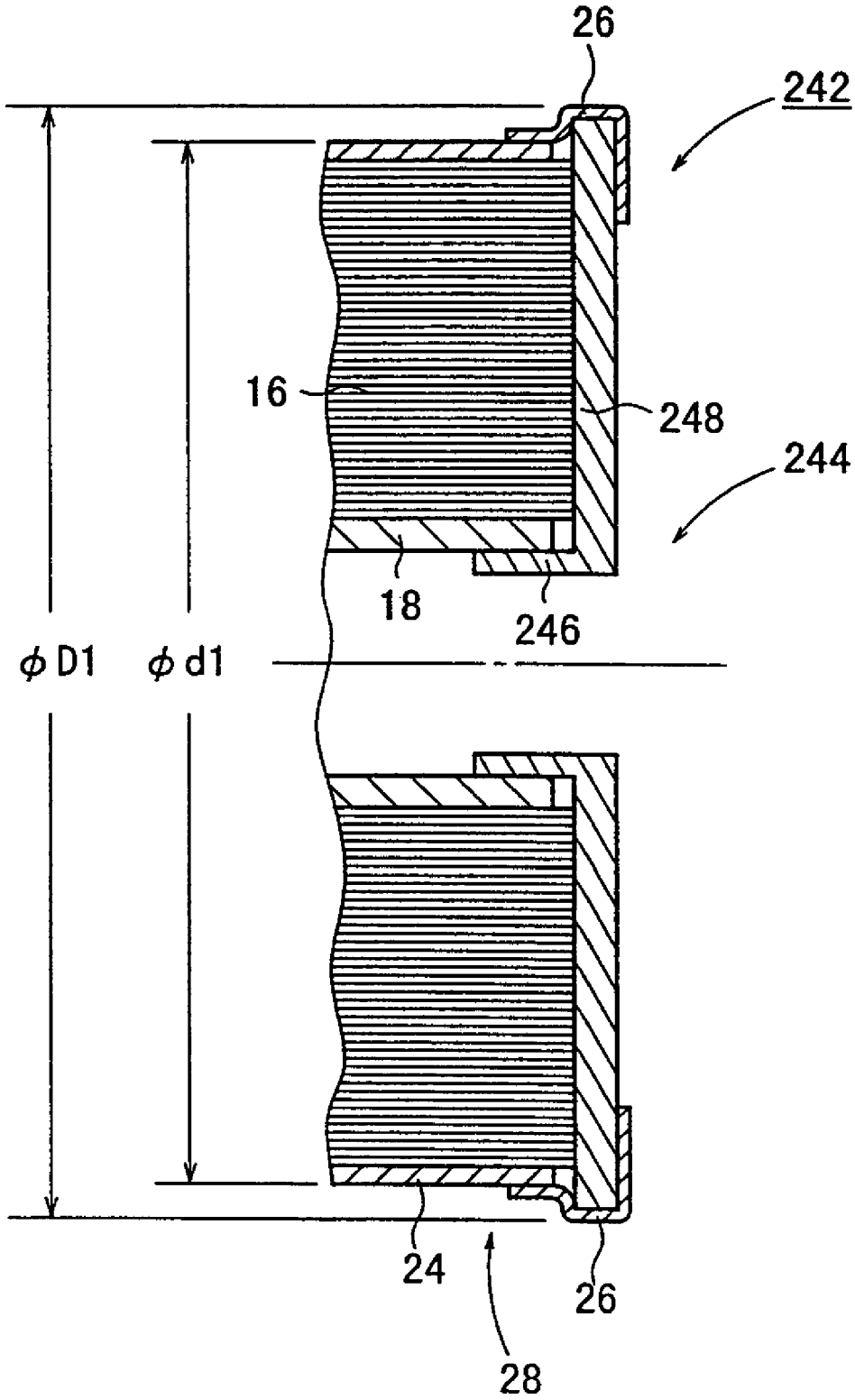
FIG. 14 is a fragmentary cross-sectional view of the light-shielded photosensitive material roll shown in FIG. 13.

As shown in FIGS. 13 and 14, a light-shielded photosensitive material roll 142 packaged by the packaging system 12*a* has a pair of cap-shaped light-shielding members 244 mounted on the opposite ends of the core 18. Each of the cap-shaped light-shielding members 244 comprises a projection 246 to be inserted into the core 18 and a flange 248 integral with the projection 246. The flange 248 has a diameter D1 greater than the diameter d1 of the rolled photosensitive material sheet 20 and a relatively large thickness so that the flange 248 will not be deformed when covered with the light-shielding shrinkable film 26.

The light-shielded photosensitive material roll 142 is sufficiently shielded from light when the outer edges of the flanges 248 of the light-shielding members 244 are covered with the light-shielding shrinkable films 26. The light-shielding shrinkable films 26 are not required to be bonded to the flanges 248.

Therefore, the packaging apparatus 240 does not require any heat seal bonder, and includes the heater units 106*a*, 106*b* positioned in association with the opposite edges of the rolled photosensitive material sheet 20, i.e., the light-shielding shrinkable films 26, for applying hot air locally to only the light-shielding shrinkable films 26 to package the rolled photosensitive material sheet 20.

In the second embodiment, the packaging apparatus 240 as a whole is relatively small in size and simple in structure. The packaging apparatus 240 also offers the same advantages as with the first embodiment as the heater capacity is reduced to achieve smaller power requirements.

Figure 15:
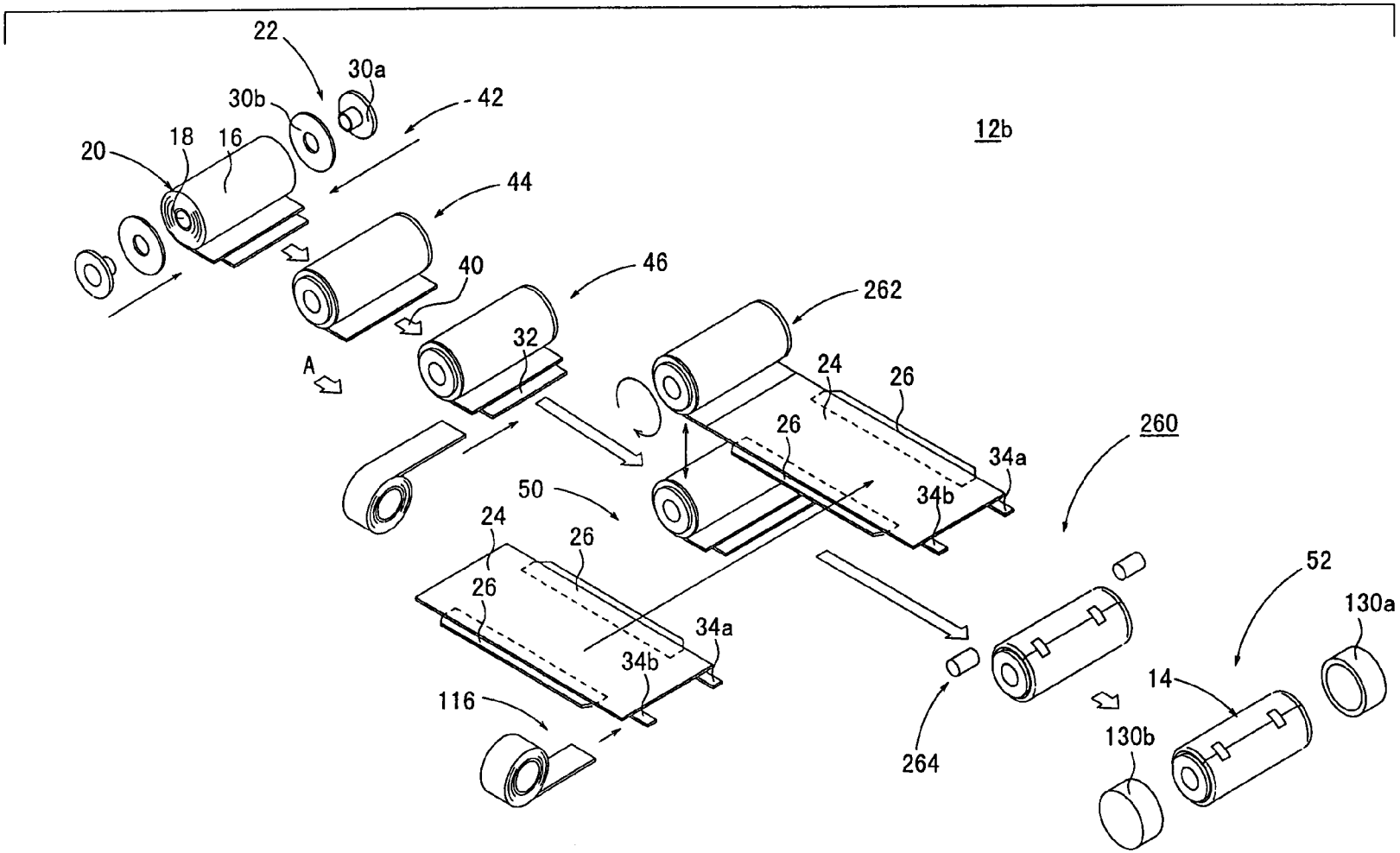
FIG. 15 is a schematic perspective view of a packaging system which incorporates a packaging apparatus according to a third embodiment of the present invention.

FIG. 15 schematically shows in perspective a packaging system 12*b* which incorporates a packaging apparatus 260 according to a third embodiment of the present invention. Those parts of the packaging system 12*b* which are identical to those of the first embodiment are denoted by identical reference characters, and will not be described in detail below.

As shown in FIG. 15, the packaging system 12*b* has the roll end positioner 44, the joint tape applicator 46, a light-shielding leader take-up unit 262, the light-shielding leader supply 50, and a heat shrinkage unit 264. In the light-shielding leader take-up unit 262, after the light-shielding leader 28 is joined to the end of the rolled photosensitive material sheet 20 by the joint tape 32, the rolled photosensitive material sheet 20 is rotated to wind the light-shielding leader 28, and the end of the light-shielding leader 28 is fixed in position by the end fixing tapes 34*a*, 34*b*. In the heat shrinkage unit 264, hot air is ejected locally to the light-shielding shrinkable films 26 wound on the rolled photosensitive material sheet 20 to heat-shrink the light-shielding shrinkable films 26.

Figure 16:
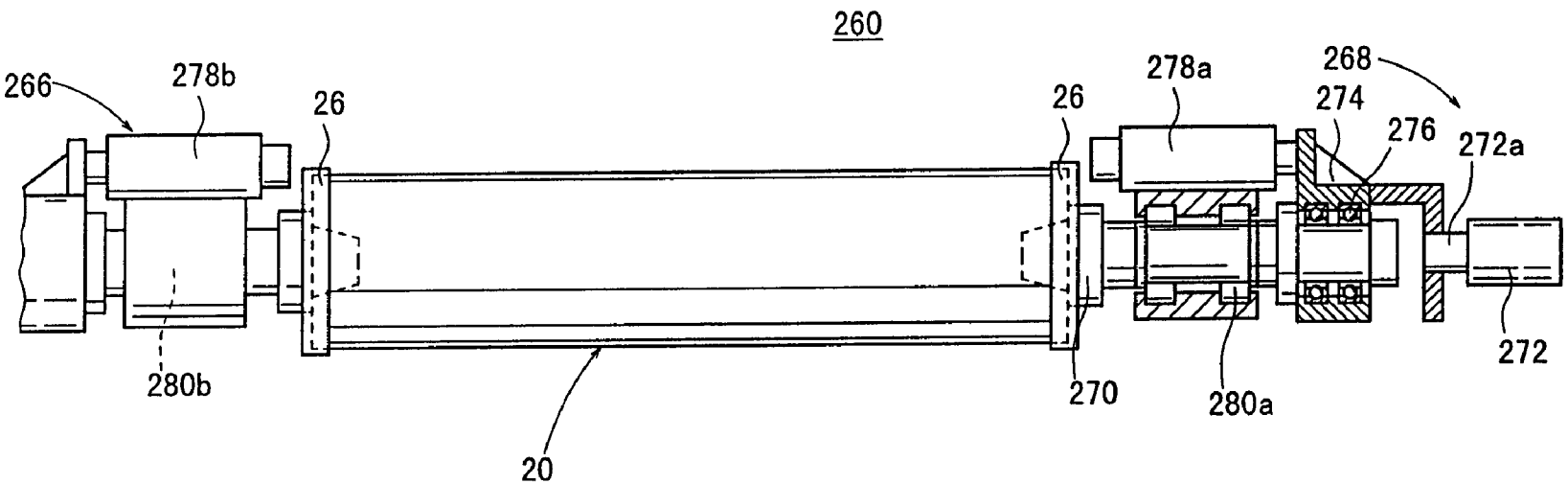
FIG. 16 is a side elevational view, partly in cross section, of the packaging apparatus shown in FIG. 15.

As shown in FIG. 16, the packaging apparatus 260 which is incorporated in the heat shrinkage unit 264 has a pair of hot air supply mechanisms 266 and a drive mechanism 268 for rotating the hot air supply mechanisms 266 along the outer circumference of the rolled photosensitive material sheet 20. The heat shrinkage unit 264 has a pair of central chucks 270 for supporting the core 18 with light-shielding leader 28 wound on the rolled photosensitive material sheet 20, and the drive mechanism 268 has a pair of motors 272 disposed coaxially with the central chucks 270.

Rotary arms (rotary arm members) 274 are fixed to drive shafts 272*a* of the motors 272, and rotatably supported on the central chucks 270 by respective bearings 276. The hot air supply mechanisms 266 have heater units 278*a*, 278*b* mounted respectively on ends of the rotary arms 274 and supported on the central chucks 270 by cam followers 280*a*, 280*b*.

After the light-shielding leader 28 is wound on the rolled photosensitive material sheet 20 by the light-shielding leader take-up unit 262, the rolled photosensitive material sheet 20 is delivered to the heat shrinkage unit 264. In the heat shrinkage unit 264, the central chucks 270 have been fitted in the respective ends of the core 18. The motors 272 of the drive mechanism 268 are energized to rotate the rotary arms 274 fixed to the drive shafts 272*a* on the bearings 276. At this time, the heater units 106*a*, 106*b* mounted on the rotary arms 274 ejects hot air locally to the light-shielding shrinkable films 26, which are heat-shrunk over the outer edges of the light-shielding members 22, thus packaging the rolled photosensitive material sheet 20.

In the third embodiment, after the light-shielding shrinkable films 26 are wound around the rolled photosensitive material sheet 20, the heater units 278*a*, 278*b* are rotated along the outer circumference of the rolled photosensitive material sheet 20 by the drive mechanism 268 while at the same time the heater units 278*a*, 278*b* eject hot air to the light-shielding shrinkable films 26. Therefore, only the light-shielding shrinkable films 26 are reliably heated. The packaging apparatus 260 is relatively small in size and simple in structure, and has reduced power requirements, as with the packaging apparatus according to the first and second embodiments.

Figure 17:
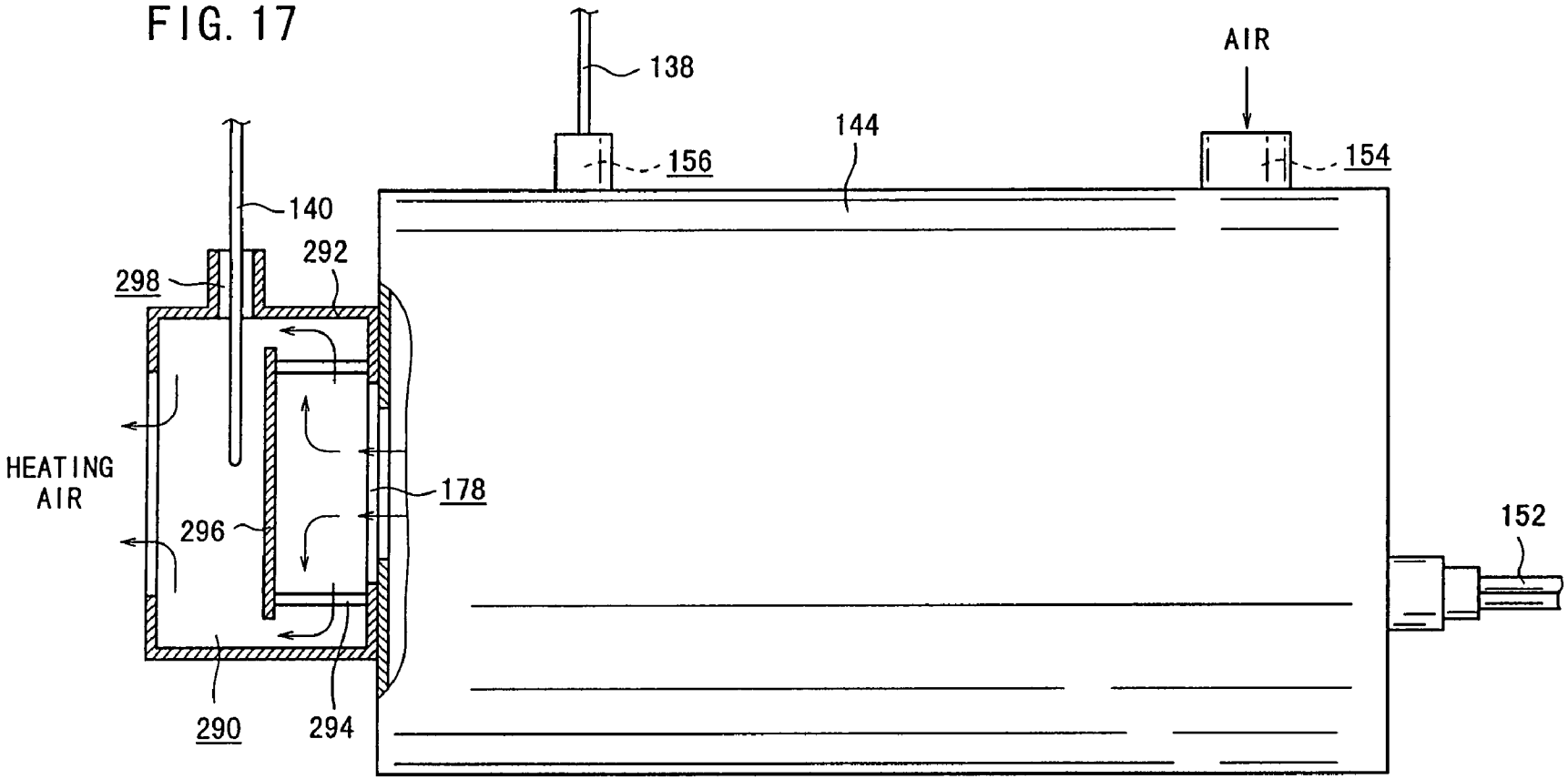
FIG. 17 is a cross-sectional view of a light-shielding chamber according to another embodiment of the present invention for use in the fluid heating and supplying apparatus.

FIG. 17 shows a second light-shielding chamber 290 according to another embodiment (fourth embodiment) of the present invention, for use in the tip ends of the heater units 106*a*, 106*b* shown in FIG. 8. The second light-shielding chamber 290 comprises an outer casing 292 mounted on the end of the outer casing 144 and a light-shielding plate 296 mounted centrally in the outer casing 292 and supported in position by ribs 294. The discharged air temperature sensor 140 is inserted centrally in the outer casing 292 through a sensor insertion hole 298.

Inner wall surfaces of the second light-shielding chamber 290 are coated with a heat-resistant light-shielding paint coating layer or processed into a roughened surface for a sufficient light-shielding effect.

Figure 18:
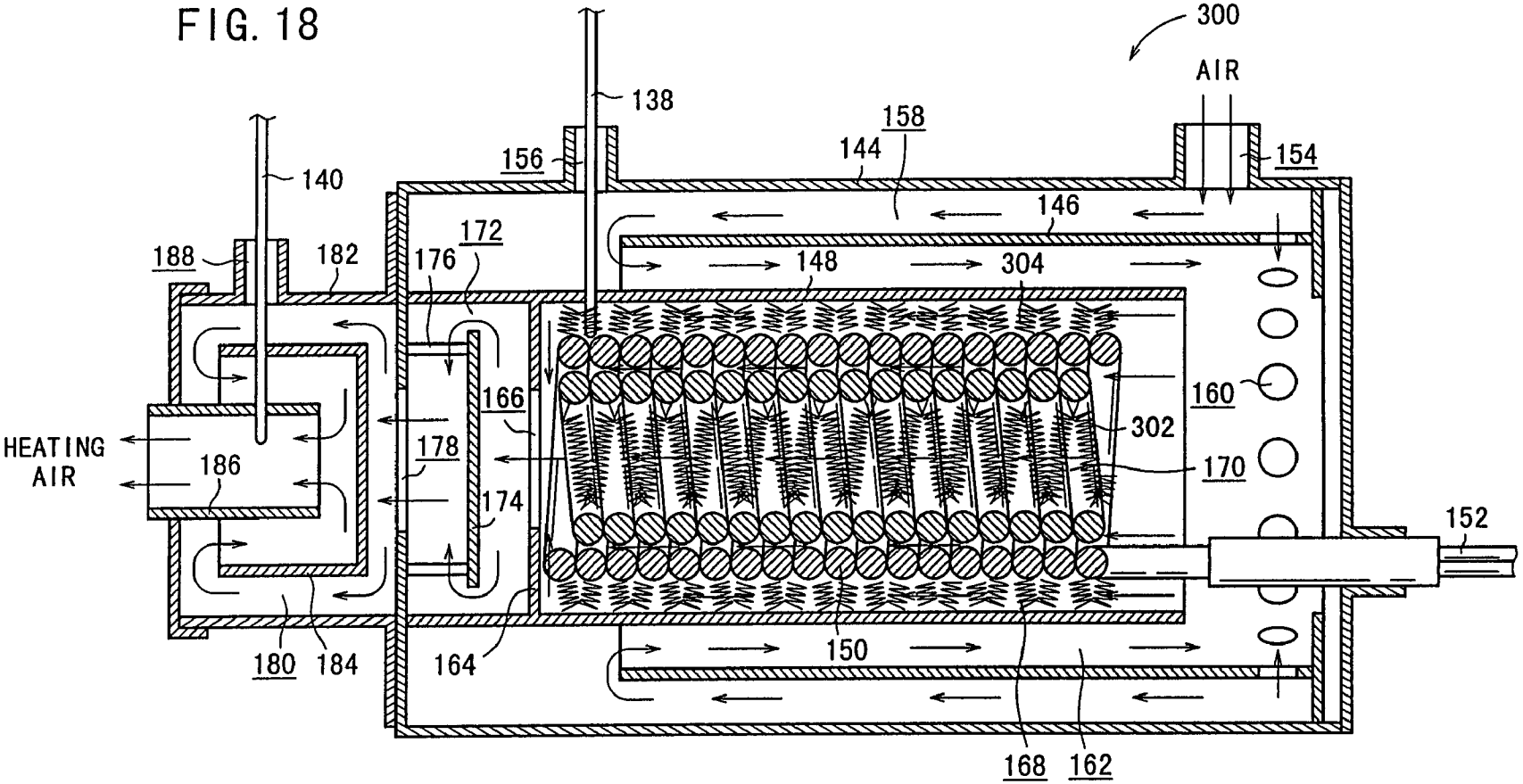
FIG. 18 is a cross-sectional view of a heater unit according to still another embodiment of the present invention for use in the fluid heating and supplying apparatus.

FIG. 18 shows in cross section a heater unit 300 according to still another embodiment (fifth embodiment) of the present invention. As shown in FIG. 18, the heater unit 300 has a coiled metal wire 302 disposed in the fourth passage 170 in the heating coil 150 and a coiled metal wire 304 disposed around the heating coil 150.

The coiled metal wire 302 comprises a small-diameter coiled spring of SUS or the like which is further deformed into a coiled configuration and placed in the fourth passage 170. Air which is introduced into the fourth passage 170 is resisted by the coiled metal wire 302 and reduces its speed, during which time the heat generated by the heating coil 150 is effectively applied to the air directly or through the coiled metal wire 302. As a result, the air is heated with a high heat exchange rate.

The coiled metal wire 304, which is identical to the coiled metal wire 302, is disposed around the heating coil 150. Since the outer circumference of the heating coil 150 is covered with the coiled metal wire 304, it is held out of contact with the second inner casing 148, which is prevented from being overheated. The coiled metal wire 304 has gaps for allowing part of the introduced air to pass therethrough. Since the air flowing through these gaps is heated by the heat of the heating coil 150, the coiled metal wire 304 is capable of achieving an increased heat insulating effect and an increased heating efficiency.

Figure 19:
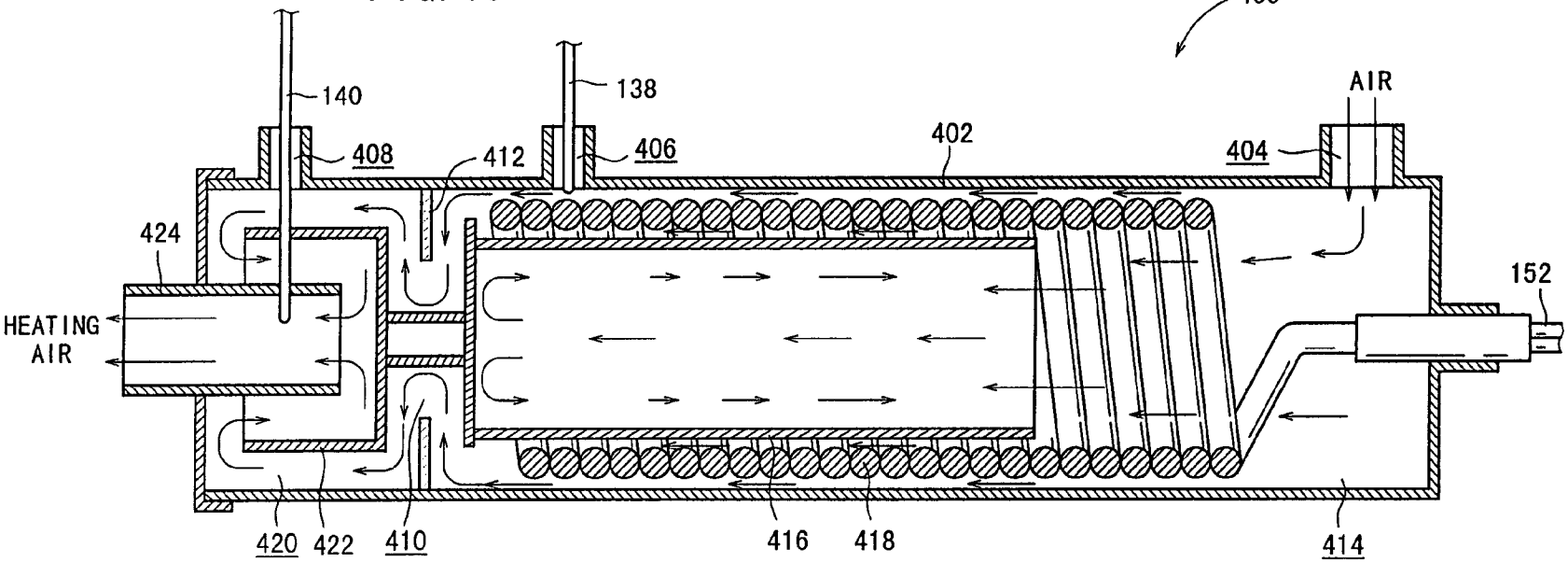
FIG. 19 is a cross-sectional view of a heater unit according to yet another embodiment of the present invention for use in the fluid heating and supplying apparatus.
Figure 20:
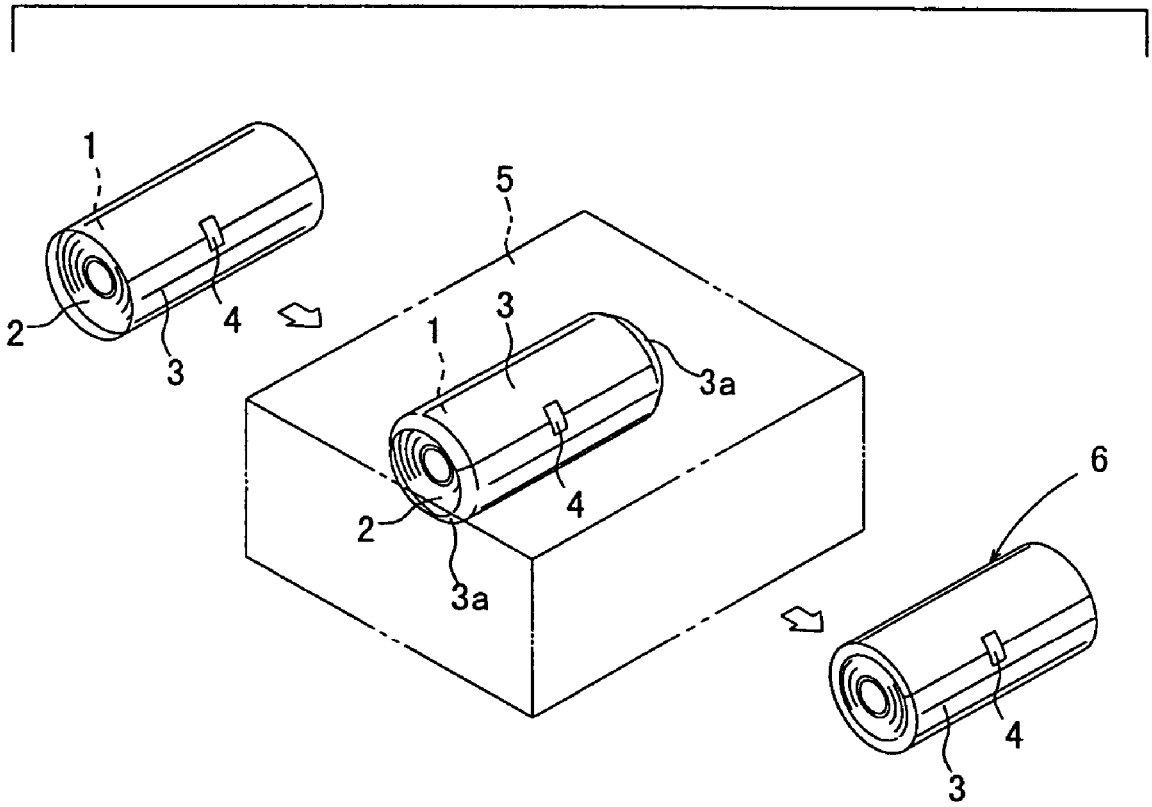
FIG. 20 is a schematic perspective view illustrative of a process of manufacturing a conventional light-shielded photosensitive material roll.
Figure 21:
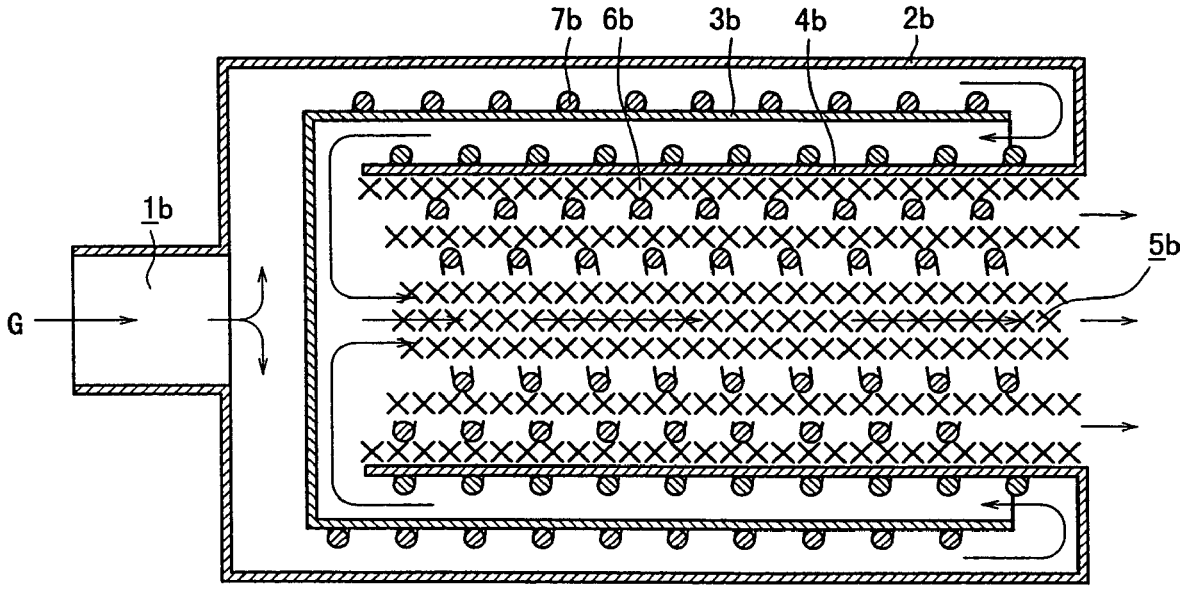
PRIOR ART FIG. 21
FIG. 21 is a cross-sectional view of a conventional exhaust gas purifying apparatus.

FIG. 19 shows in cross section a heater unit 400 according to yet another embodiment (sixth embodiment) of the present invention. The heater unit 400 comprises a cylindrical outer casing 402 having an air inlet 404 defined in an end thereof, a sensor insertion hole 406 defined in a substantially central wall thereof for insertion of the heating coil temperature sensor 138, and a sensor insertion hole 406 defined in the other end thereof for insertion of the discharged air temperature sensor 140. A partition 412 with a central hole 410 defined therein is disposed in the outer casing 402 and mounted on an inner circumferential wall thereof between sensor insertion holes 406, 408.

A space defined between the partition 412 and one end of the outer casing 402 serves as a heating chamber 414. A heating coil (heating body) 418 is disposed between the outer circumferential surface of the inner casing 416 and the inner circumferential surface of the outer casing 402.

A space defined between the partition 412 and the other end of the outer casing 402 serves as a light-shielding chamber 420. A bottomed cylindrical inner casing 422 is disposed in the light-shielding chamber 420 and connected to the bottom of the inner casing 416 though the hole 410. A nozzle 424 is disposed in the inner casing 422.

Air supplied via the air inlet 404 into the heating chamber 414 in the outer casing 402 is temporarily introduced into the inner casing 416 and preheated therein, and then passes between the inner casing 416 and the outer casing 402, during which the air is heated to a predetermined temperature by the heating coil 418. The heated air is introduced through the hole 410 into the light-shielding chamber 420, from which the air is discharged out of the heater unit 400 through a labyrinth passage that is defined by the partition 412 and the nozzle 424.

The air is sufficiently heated when it passes through the inner casing 416 and the passage between the inner casing 416 and the outer casing 402, and is supplied via the light-shielding chamber 420 to the light-shielding shrinkable films 26. Therefore, the light-shielding shrinkable films 26 can efficiently be heated by the air without being adversely affected by the glow of the heating coil 418. In the sixth embodiment, the outer casing 402 may be made of a material of low thermal conductivity such as ceramics or the like to reduce the effect of heat radiation directly from the outer casing 402.

With the method of and the apparatus for packaging a light-shielded photosensitive material roll according to the present invention, while the hot air supply mechanism disposed in association with a heat-shrinkable package member is being rotated along the outer circumference of a rolled photosensitive material, hot air is ejected locally to the heat-shrinkable package member. The capacity of a heating body is reduced to effectively reduce a power requirement thereof, and the apparatus as a whole is reduced in size and simplified in structure. Since the hot air is ejected locally to only the heat-shrinkable package member, the quality of the rolled photosensitive material is effectively prevented from being adversely affected by the hot air.

Furthermore, since there is a passage in the outer circumference region of the heating body for the passage of a fluid before it is heated, the transfer of the heat out of the heating body is reduced. Therefore, the fluid heating and supplying apparatus according to the present invention has a high heat insulating capability. Objects disposed around the apparatus, other than the object to be heated by the heating body, are prevented from being adversely affected by the heat of the apparatus. A metal wire may be disposed around the heating body to keep the heating body out of contact with the inner casing or the outer casing for a higher heat insulating capability.

The light-shielding chamber of labyrinth structure which is disposed near the fluid outlet is effective to prevent the glow of the heating body from leaking toward the object to be heated. Therefore, even if the object is photosensitive, the object can be heated by the heating body without being adversely affected by the glow. With a passage defined in the outer circumference region of the fluid heating and supplying apparatus for the passage of a fluid before it is heated, the outer circumference region of the apparatus does not glow with the heat from the heating body, and hence does not adversely affect the photosensitive object.

When the fluid passes through a passage defined between the outer and inner casings and is supplied to the heating body, the fluid can efficiently be heated, and the apparatus can be reduced in size.

If a metal wire is disposed within the heating body which is wound as a coiled structure, then the fluid that is flowing in can be brought into positive contact with the heating body and heated thereby, or can be more efficiently heated by the heating wire which is heated by the heating body.

Although certain preferred embodiments of the present invention have been shown and described in detail, it should be understood that various changes and modifications may be made therein without departing from the scope of the appended claims.

What is claimed is:

1. An apparatus for heating a gas with a heating body and supplying the heated gas to an object to be heated, comprising:

a hollow outer casing having a gas inlet and a gas passage defined along an inner circumferential surface thereof;

a hollow inner casing having a gas outlet and disposed in said outer casing, said hollow inner casing having a hollow space therein communicating with said gas passage; and a heating body disposed in said inner casing for heating a gas supplied through said gas passage into said inner casing; and a light-shielding chamber having a labyrinth gas passage defined therein and disposed in said gas outlet:

the arrangement being such that said gas heated by said heating body flows out of said gas outlet and is supplied to said object to be heated.

2. An apparatus according to claim 1, further comprising:

another inner casing interposed between said outer casing and said inner casing, said outer casing and said inner casings defining a plurality of passages therebetween which are held in communication with each other in a longitudinal direction of the casings.

3. An apparatus according to claim 1, wherein said light-shielding chamber comprises a first light-shielding chamber having said labyrinth gas passage and disposed in said gas outlet, and a second light-shielding chamber having said labyrinth gas passage and connected to said first light-shielding chamber, for discharging out said gas.

4. An apparatus according to claim 1, wherein said light-shielding chamber has inner wall surfaces coated with a heat-resistant light-shielding paint coating layer.

5. An apparatus according to claim 1, wherein said light-shielding chamber has inner wall surfaces processed into roughened surfaces.

6. An apparatus according to claim 1, wherein said heating body comprises a circularly wound heating coil and a metal wire disposed therein.

7. An apparatus according to claim 1, wherein said heating body comprises a circularly wound heating coil and a metal wire disposed therearound.

8. An apparatus for heating a fluid with a heating body and supplying the heated fluid to an object to be heated, comprising:

a hollow outer casing having a fluid inlet, a fluid outlet, and a fluid passage defined therein;

a heating body disposed in said outer casing for heating a fluid supplied from said fluid inlet into said fluid passage; and a light-shielding chamber having a labyrinth fluid passage defined therein and disposed in said fluid outlet;

the arrangement being such that said fluid heated by said heating body flows out of said light-shielding chamber and is supplied to said object to be heated.

9. An apparatus according to claim 8, wherein said light-shielding chamber comprises a first light-shielding chamber having said labyrinth fluid passage and disposed in said fluid outlet, and a second light-shielding chamber having said labyrinth fluid passage and connected to said first light-shielding chamber, for discharging out said fluid.

10. An apparatus according to claim 8, wherein said light-shielding chamber has inner wall surfaces coated with a heat-resistant light-shielding paint coating layer.

11. An apparatus according to claim 8, wherein said light-shielding chamber has inner wall surfaces processed into roughened surfaces.

12. An apparatus according to claim 8, wherein said heating body comprises a circularly wound heating coil and a metal wire disposed therein.

13. An apparatus according to claim 8, wherein said heating body comprises a circularly wound heating coil and a metal wire disposed therearound.

14. An apparatus for heating a fluid with a heating body and supplying the heated fluid to an object to be heated, comprising:

a hollow outer casing having a fluid inlet, a fluid outlet, and a fluid passage defined therein;

a hollow inner casing disposed in said outer casing and having a hollow space therein communicating with said fluid passage; and a heating body disposed in said outer casing for heating a fluid supplied from said fluid inlet; and a light-shielding chamber having a labyrinth fluid passage defined therein and disposed in said fluid outlet;

the arrangement being such that the fluid flows through said inner casing, said heating body, and said light-shielding chamber, and thereafter is discharged and supplied to said object to be heated.

15. An apparatus according to claim 14, wherein said light-shielding chamber comprises a first light-shielding chamber having said labyrinth fluid passage and disposed in said fluid outlet, and a second light-shielding chamber having said labyrinth fluid passage and connected to said first light-shielding chamber, for discharging out said fluid.

16. An apparatus according to claim 14, wherein said light-shielding chamber has inner wall surfaces coated with a heat-resistant light-shielding paint coating layer.

17. An apparatus according to claim 14, wherein said light-shielding chamber has inner wall surfaces processed into roughened surfaces.

18. An apparatus according to claim 14, wherein said heating body comprises a circularly wound heating coil and a metal wire disposed therein.

19. An apparatus according to claim 14, wherein said heating body comprises a circularly wound heating coil and a metal wire disposed therearound.

* * * * *